US010578268B2

(12) United States Patent
Wang

(10) Patent No.: US 10,578,268 B2
(45) Date of Patent: Mar. 3, 2020

(54) SMART HEADLIGHT

(71) Applicant: CHIAN YIH OPTOTECH CO., LTD., Mial-Li Hsien (TW)

(72) Inventor: Cheng Wang, Taipei (TW)

(73) Assignee: CHIAN YIH OPTOTECH CO., LTD., Mial-Li Hsien (TW)

( * ) Notice: Subject to any disclaimer, the term of this patent is extended or adjusted under 35 U.S.C. 154(b) by 0 days.

(21) Appl. No.: 16/261,492

(22) Filed: Jan. 29, 2019

(65) Prior Publication Data

US 2019/0234580 A1 Aug. 1, 2019

(30) Foreign Application Priority Data

Jan. 29, 2018 (TW) ..... 107103078 A

(51) Int. Cl.

| | |
|---|---|
| ***F21S 41/00*** | (2018.01) |
| ***F21S 41/692*** | (2018.01) |
| ***F21S 41/143*** | (2018.01) |
| ***F21S 41/36*** | (2018.01) |
| ***F21S 45/43*** | (2018.01) |
| ***F21S 45/47*** | (2018.01) |
| ***F21S 41/20*** | (2018.01) |
| ***F21S 41/689*** | (2018.01) |
| ***F21S 41/55*** | (2018.01) |
| ***F21S 41/365*** | (2018.01) |

(Continued)

(52) U.S. Cl.

CPC ..... *F21S 41/692* (2018.01); *F21S 41/143* (2018.01); *F21S 41/147* (2018.01); *F21S 41/148* (2018.01); *F21S 41/192* (2018.01); *F21S 41/255* (2018.01); *F21S 41/285* (2018.01); *F21S 41/295* (2018.01); *F21S 41/321* (2018.01); *F21S 41/36* (2018.01); *F21S 41/365* (2018.01); *F21S 41/39* (2018.01); *F21S 41/43* (2018.01); *F21S 41/55* (2018.01); *F21S 41/689* (2018.01); *F21S 45/43* (2018.01); *F21S 45/47* (2018.01); *F21W 2102/13* (2018.01)

(58) Field of Classification Search

CPC ..... F21S 41/692; F21S 41/295; F21S 41/55; F21S 41/365; F21S 41/147; F21S 41/36; F21S 41/255; F21S 41/141–153; F21S 41/40–47

USPC ..... 362/516–517, 538–539, 543, 547

See application file for complete search history.

(56) References Cited

U.S. PATENT DOCUMENTS

2004/0141330 A1* 7/2004 Takada ..... F21S 41/162 362/516

2006/0120096 A1* 6/2006 Naganawa ..... F21S 41/17 362/539

(Continued)

*Primary Examiner* — Gerald J Sufleta, II

(74) *Attorney, Agent, or Firm* — Li & Cai Intellectual Property Office

(57) ABSTRACT

A smart headlight includes a headlight mount, a main light source, a lens and a light-shielding structure. The main light source is disposed on the headlight mount. The lens is connected to the headlight mount and corresponds in position to the main light source. The light shielding structure is disposed on the headlight mount and arranged between the main light source and the lens. The light shielding structure includes a first light-shielding plate and a second light-shielding plate. The first light-shielding plate is configured to reciprocally move between an upright position and a reclined position, such that a top portion of the second light-shielding plate can be covered by or exposed from the first light-shielding plate.

18 Claims, 24 Drawing Sheets

(51) Int. Cl.

| | |
|---|---|
| ***F21S 41/32*** | (2018.01) |
| ***F21S 41/255*** | (2018.01) |
| ***F21S 41/43*** | (2018.01) |
| ***F21S 41/147*** | (2018.01) |
| ***F21S 41/39*** | (2018.01) |
| ***F21S 41/19*** | (2018.01) |
| ***F21S 41/148*** | (2018.01) |
| ***F21S 41/29*** | (2018.01) |
| *F21W 102/13* | (2018.01) |

(56) References Cited

U.S. PATENT DOCUMENTS

| | | | | |
|---|---|---|---|---|
| 2010/0110710 | A1* | 5/2010 | Abe | F21S 41/147<br>362/514 |
| 2011/0261576 | A1* | 10/2011 | Uchida | F21S 41/255<br>362/512 |
| 2013/0188378 | A1* | 7/2013 | Yamamoto | F21V 13/04<br>362/512 |
| 2013/0272009 | A1* | 10/2013 | Fujiu | B60Q 1/0058<br>362/517 |
| 2014/0313760 | A1* | 10/2014 | Yagi | F21S 41/143<br>362/520 |
| 2015/0260366 | A1* | 9/2015 | Youn | F21S 41/147<br>362/512 |
| 2016/0040848 | A1* | 2/2016 | Tsukamoto | F21S 41/24<br>362/509 |
| 2018/0112845 | A1* | 4/2018 | Tanaka | F21S 41/255 |
| 2018/0281671 | A1* | 10/2018 | Na | F21S 41/663 |
| 2019/0056082 | A1* | 2/2019 | Abe | F21V 29/76 |
| 2019/0242544 | A1* | 8/2019 | Chen | F21S 41/365 |

* cited by examiner

SMART HEADLIGHT

CROSS-REFERENCE TO RELATED PATENT APPLICATION

This application claims the benefit of priority to Taiwan Patent Application No. 107103078, filed on Jan. 29, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a vehicle headlight, and more particularly to a smart headlight of a car which can provide lighting patterns adapted to different road environments.

BACKGROUND OF THE DISCLOSURE

The headlamp, referred to by some as the "eyes" of a car, is very important to traffic safety. The early car headlights only include low-beam and high-beam modules, so that light distribution patterns provided thereof are stationary and cannot be adjusted according to the car's driving conditions and the changes of the external environment. Therefore, the use of the aforesaid car headlight has many disadvantages. For example, when a vehicle, in which the headlight has a near illumination distance, is driving on a highway, the driver cannot respond immediately to a sudden accident. In addition, when a vehicle, in which the headlight has a narrow illumination distance, is driving on a town road, rainy road, or curve, there may exist light-dark areas at front left and front right sides of the vehicle and thus the driver may ignore road conditions of the road sides and result in a traffic accident.

With the advancement of technology, more and more headlights using the adaptive front-lighting system (AFS) are provided. Such headlights can be controlled by the AFS to rotate in the left-right or up-down direction according to a rotation angle of the steering wheel, a driving speed and a car turning radius. Accordingly, the headlights provide a light distribution patterns complying with current road environments and an illumination direction same as the driving direction. Therefore, the driver would have the best view field and safe illuminations under various road environments can be ensured. However, such headlights have a complicated structure and require a plurality of driving devices to respectively control the movements in the left-right and up-down directions of the light distribution patterns.

In order to convert the light distribution pattern, a common way is using different modules that cooperate with each other. For example, some of the modules for producing a high-beam light-condensing pattern, a low-beam light-condensing pattern, a low-beam light-diffusing pattern, and other light distribution patterns can be turned on or off. Another common way is using a converting mechanism such as a drum, which is provided with different light distribution patterns each having a cut-off line, to being rotated a desired light distribution pattern to the focal point of the lens for projection. However, these ways cannot meet the requirements of miniaturization, light weight, and low cost, and the optical designs thereof are complicated and difficult for population. In addition, these ways may occupy a large amount of space and thus there is insufficient space in the front of the car body for the installation of the cornering light.

SUMMARY OF THE DISCLOSURE

In response to the above-referenced technical inadequacies, the present disclosure provides a smart headlight.

In one aspect, the present disclosure provides a smart headlight which includes a headlight mount, a main light source, at least one auxiliary light source, a lens and a light shielding structure. The main light source is disposed on the headlight mount, wherein the main light source includes a first light-reflecting cup and a first light-emitting unit, the first light-reflecting cup has at least one first focal point located in an cover area of the first light-reflecting cup, and the first light-emitting unit corresponds in position to the at least one first focal point of the first light-reflecting cup. The lens is connected to the headlight mount and corresponds in position to the main light source. The light shielding structure includes a first light-shielding plate and a second light-shielding plate, wherein the first light-shielding plate is configured to reciprocally move between an upright position and a reclined position. When the first light-shielding plate is at the upright position, the second light-shielding plate is covered by the first light-shielding plate, such that lights projected from the main light source is selectively shielded by a top portion of the first light-shielding plate and refracted by the lens to produce a first illumination mode. When the first light-shielding plate is at the reclined position, a top portion of the second light-shielding plate is exposed from the first light-shielding plate, such that lights projected from the main light source is selectively shielded by the top portion of the second light-shielding plate and refracted by the lens to produce a second illumination mode. The second illumination mode has a farther illuminating distance than the first illumination mode.

In one aspect, the present disclosure provides a smart headlight which includes a headlight mount, a main light source, at least one auxiliary light source, a lens and a light shielding structure. The main light source is disposed on the headlight mount, wherein the main light source includes a first light-reflecting cup and a first light-emitting unit, the first light-reflecting cup has at least one first focal point located in a cover area of the first light-reflecting cup, and the first light-emitting unit corresponds in position to the at least one first focal point of the first light-reflecting cup. The lens is connected to the headlight mount and corresponds in position to the main light source. The light shielding structure includes a first light-shielding plate that is configured to reciprocally move between a first position and a second position lower than the first position. When the first light-shielding plate is at the first position, lights projected from the main light source is selectively shielded by a top portion of the first light-shielding plate and refracted by the lens to produce a first illumination mode. When the first light-shielding plate is at the second position, lights projected from the main light source is selectively shielded by the top portion of the first light-shielding plate and refracted by the lens to produce a second illumination mode. The second illumination mode has a farther illuminating distance than the first illumination mode.

One of the advantages of the present disclosure is that the smart headlight, in which the light shielding structure includes a first light-shielding plate and a second light-shielding structure and the first light-shielding plate is configured to reciprocally move between a first position and a second lower than the first position, can provide light distribution patterns adapted to different road environments and have bending illumination function.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
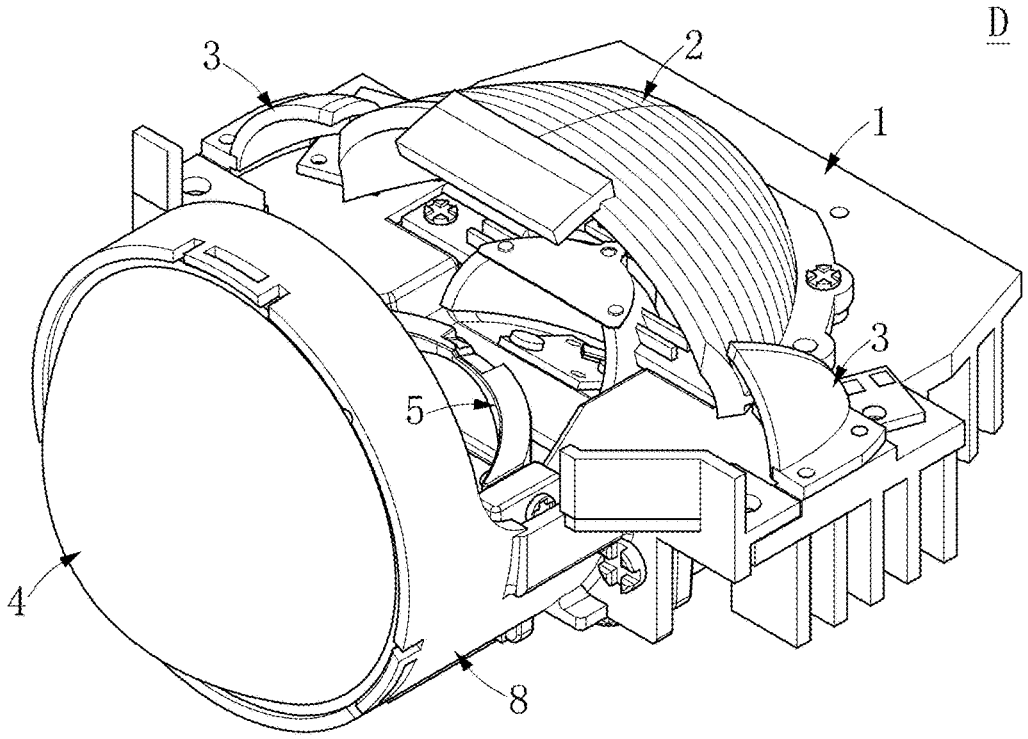
FIG. 1 is a front perspective assembled view of a smart headlight according to a first embodiment of the present disclosure.

The United Nations Economic Commission for Europe (ECE) R123 regulation specifies a plurality of low-beam illumination modes (also called "light distribution patterns") of the adaptive front lighting system (AFS), including: a basic illumination mode (i.e., C mode), a town illumination mode (i.e., V mode), a highway illumination mode (i.e., E mode) and a bad weather illumination mode (i.e., W mode). In addition, the regulation of ECE R119 specifies the light distribution pattern of the cornering light. The present disclosure provides a novel smart headlight which integrates a plurality of modules of various light distribution patterns and the high-beam illumination into a single module. The smart headlight uses a lens to cooperate with a plurality of light sources in a special arrangement and a plurality of light cups each having a special structure, such that desired illumination modes can be provided to increase the driver's view distance and thereby ensuring the driving safety.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIGS. 1 to 4, the smart headlight D according to the first embodiment of the present disclosure includes a headlight mount 1, a main light source 2, at least one auxiliary light source 3, a lens 4 and a light-shielding structure 5. The main light source 2 is disposed on the headlight mount 1 and the at least one auxiliary light source 3 is disposed next to the main light source 2. The lens 4 is connected to the headlight mount 1 and corresponds in position to the main light source 2. The light-shielding structure 5 is disposed on the headlight mount 1 and arranged between the main light source 2 and the lens 4. Therefore, the smart headlight D can cooperate with an automatic control system (not shown) to be automatically switched to a desired illumination mode depending on particular requirements.

In the present embodiment, the number of the auxiliary light source 3 is preferably two. The two auxiliary light sources 3 are symmetrically disposed at two opposite sides of the main light source 2, but are not limited thereto. In other embodiments, the two auxiliary light sources 3 can be asymmetrically arranged with respect to the main light source 2. It should be noted that, although the following description is about the cooperation between the main light source 2 and the two auxiliary light sources 3 for producing illumination modes in compliance with regulations, in practice, the number of the auxiliary light sources 3 can be more than two.

Referring to FIGS. 3 to 5 and 8 to 12, the headlight mount 1 has a first supporting surface 11 for installation of the main light source 2, the auxiliary light source 3, and the light-shielding structure 5. The main light source 2 includes a first light-reflecting cup 21 and a first light-emitting unit 22. The first light-reflecting cup 21 can be fixed on the first supporting surface 11 by at least one fixing member such as a fixing screw, so as to reflect the lights generated from the first light-emitting unit 22. The first light-reflecting cup 21 has a reflecting surface such as a partial ellipsoidal surface which can be composed of only one curved surface or a plurality of curved surfaces of different curvatures, but is not limited thereto. The first light-reflecting cup 21 has at least one first focal point 21*a* and at least one second focal point 21*b*. The at least one first focal point 21*a* is located in the cover area of the first light-reflecting cup 21 and the at least one second focal point 21*b* is located outside the cover area of the first light-reflecting cup 21. In the present embodiment, the first light-reflecting cup 21 is provided for light condensation, and the at least one second focal point 21*b* thereof can be located on a lens focal point A of the lens 4 and coincide with a lens focal point 4*a*, but the present disclosure is not limited thereto. In other embodiments, the at least one second focal point 21*b* of the first light-reflecting cup 21 can be deviated from the lens focal point A and in the vicinity of the lens focal point 4*a*.

Figure 8:
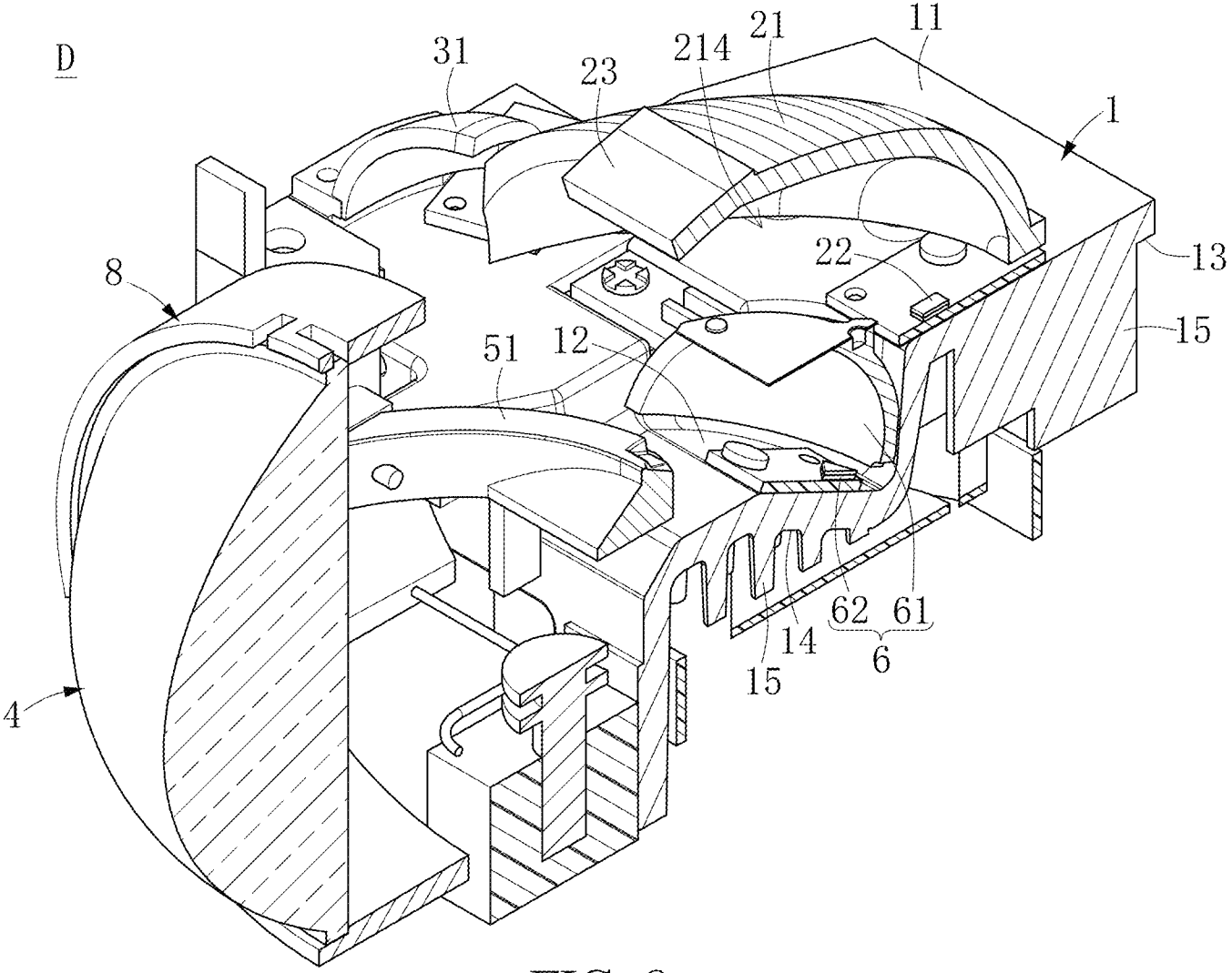
FIG. 8 is a perspective view of the smart headlight in a use state according to the first embodiment of the present disclosure.

In the present embodiment, the main light source 2 can further include a light-guiding plate 23 if desired. The light-guiding plate 23 is connected to the first light-reflecting cup 21 to guide a fraction of the lights generated from the first light-emitting unit 22 to a predetermined position. More specifically, as shown in FIG. 8, the first light-reflecting cup 21 has an opening 214 facing the lens 4 and the light-guiding plate 23 is disposed above the opening 214. The effects related to the arrangement the light-guiding plate 23 will be described hereinafter in detail, and will not be reiterated herein.

Figure 9:
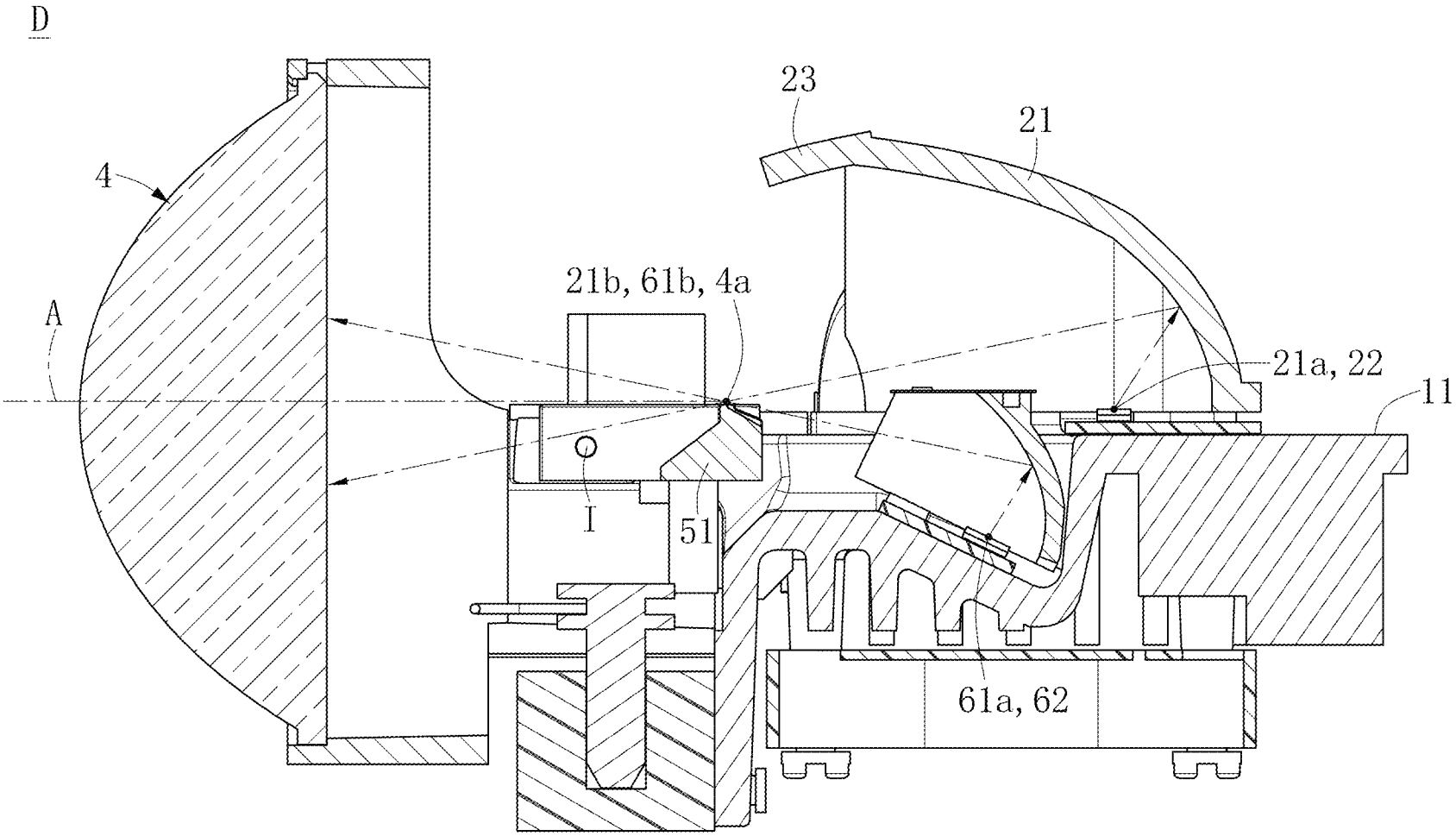
FIG. 9 is a planar sectional view of the smart headlight in a use state according to the first embodiment of the present disclosure.
Figure 11:
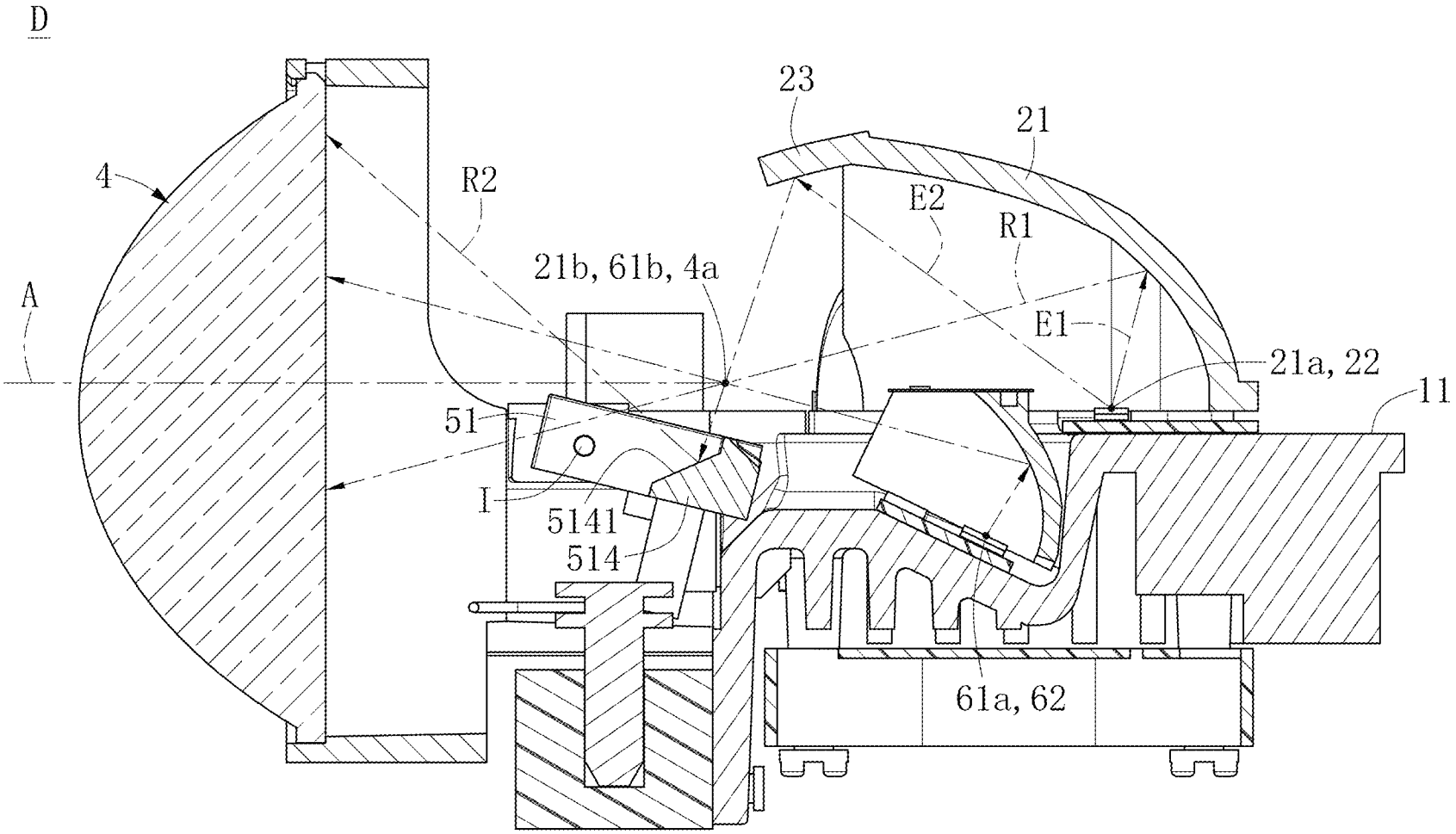
FIG. 11 is a planar sectional view of the smart headlight in another use state according to the first embodiment of the present disclosure.

The first light-emitting unit 22 is disposed on a PCB (not numbered), and the PCB has a driving circuit of the first light-emitting unit 22. The PCB can be fixed on the first supporting surface 11 by at least one fixing member such as a fixing screw. The first light-emitting unit 22 can be an LED or a package structure including a plurality of LEDs. The first light-emitting unit 22 corresponds in position to the at least one first focal point 21*a* of the first light-reflecting cup 21. In the present embodiment, as shown in FIGS. 9 and 11, the first light-reflecting cup 21 can only have a first focal point 21*a* and a second focal point 21*b*. The first light-emitting unit 22 can be arranged on or in proximity to the first focal point 21*a*, and a primary lighting surface (not numbered) thereof is parallel to the supporting surface 11, but the present disclosure is not limited thereto.

Figure 6:
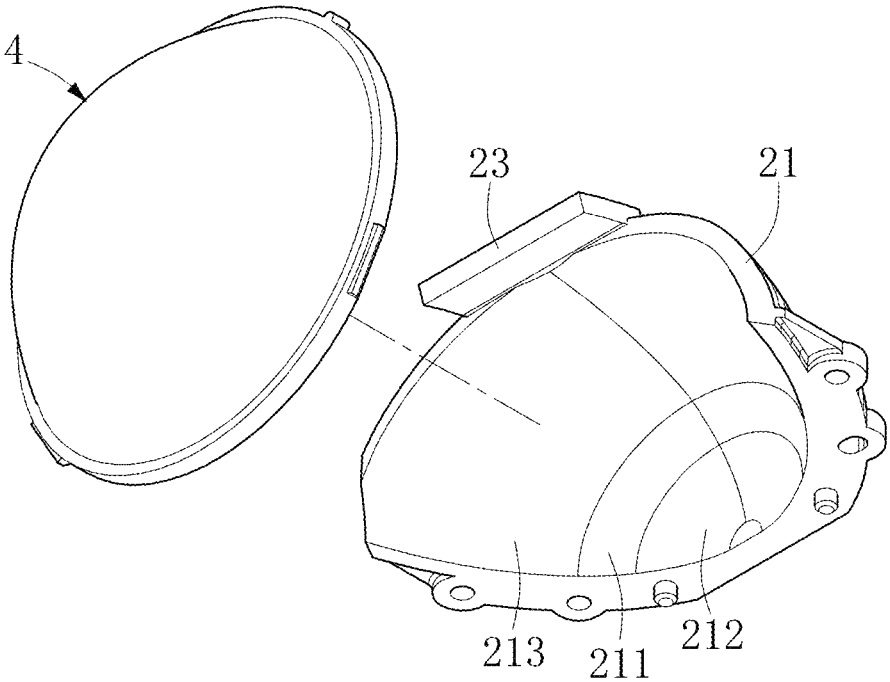
FIG. 6 is a schematic view of a first light-reflecting cup and a lens of the smart headlight according to the first embodiment of the present disclosure.
Figure 7:
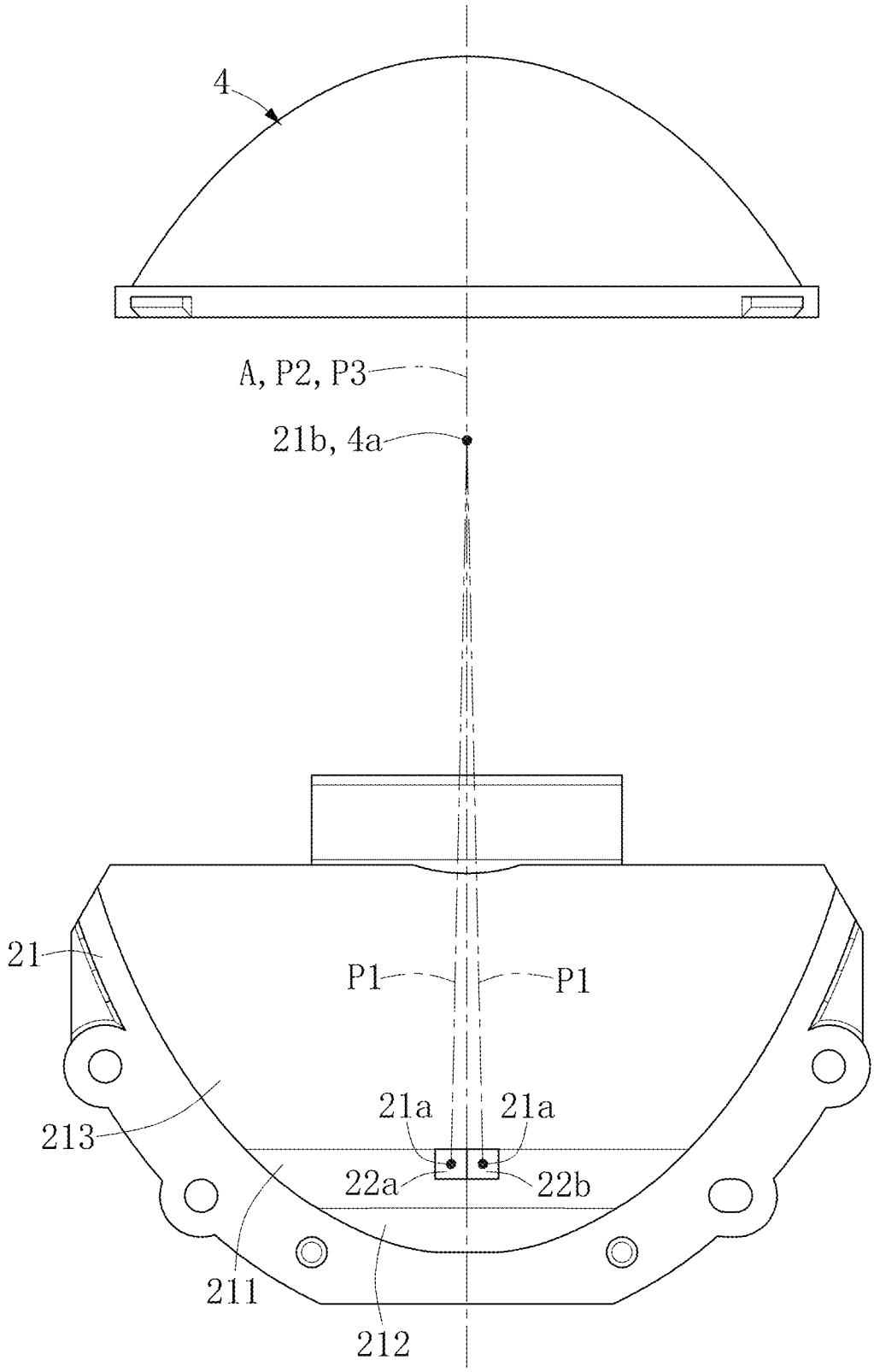
FIG. 7 is a schematic view of a main light source and the lens of the smart headlight according to the first embodiment of the present disclosure.

In the present embodiment, as shown in FIGS. 6 and 7, the first light-reflecting cup 21 can have two first focal points 21*a* and two second focal points 21*b* and the first light-emitting unit 22 can include two lighting elements 22*a*, 22*b*. Each of the lighting elements 22*a*, 22*b* can be an LED or a package structure including a plurality of LEDs. More specifically, the reflecting surface of the first light-reflecting cup 21 can include a first sub-reflecting surface 211, a second sub-reflecting surface 212 and a third sub-reflecting surface 213, and the first sub-reflecting surface 211 is connected between the second sub-reflecting surface 212 and the third sub-reflecting surface 213. The first sub-reflecting surface 211 has two first focal points 21*a* located in the cover area thereof and two second focal points 21*b* located outside the cover area thereof, wherein the second focal points 21*b* coincide with the lens focal point 4*a*. The two lighting elements 22*a*, 22*b* are respectively arranged on the two first focal points 21*a* and the shortest distance therebetween can be from 0.2 mm to 5 mm.

More specifically, the first sub-reflecting surface 211 has two optical axes P1, the second sub-reflecting surface 212 has an optical axis P2, and the third sub-reflecting surface 213 has an optical axis P3. The two optical axes P1, P2 of the first sub-reflecting surface 211 respectively pass through the two lighting elements 22*a*, 22*b*. One of the optical axes P1 is an axis passing through one of the first focal points 21*a* and one of the second focal points 21*b*. The other one of the optical axes P1 is an axis passing through the other one of the first focal points 21*a* and the other one of the second focal points 21*b*. The optical axis P2 of the second sub-reflecting surface 212 and the optical axis P3 of the third sub-reflecting surface 213 are located between the two lighting elements 22*a*, 22*b*. Preferably, the optical axis P2 of the second sub-reflecting surface 212 coincides with the optical axis P3 of the third sub-reflecting surface 213, but is not limited thereto.

Figure 12:
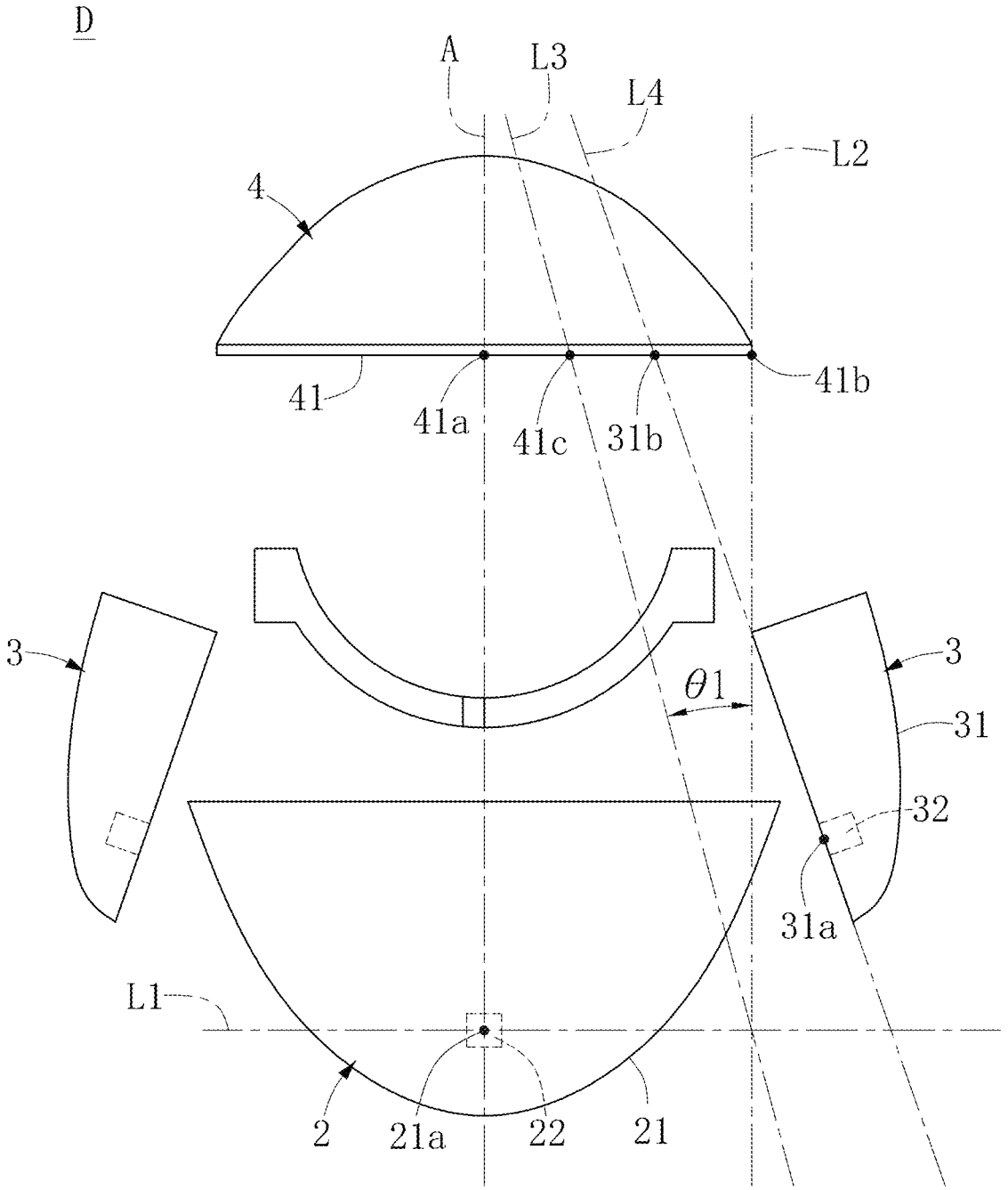
FIG. 12 is a schematic view showing an optical configuration of the smart headlight according to the first embodiment of the present disclosure.

Referring to FIGS. 3 to 5 and 8 to 12, each of the auxiliary light source 3 includes a second light-reflecting cup 31 and a second light-emitting unit 32. The second light-reflecting cup 31 can be fixed on the first supporting surface 11 by at least one fixing member such as a fixing screw, so as to reflect the lights generated from the second light-emitting unit 32. The shortest distance between the first light-reflecting cup 21 and the second light-reflecting cup 31 can be from 0.1 mm to 30 mm, preferably from 1 mm to 10 mm. The second light-reflecting cup 31 has a reflecting surface such as a partial ellipsoidal surface which can be composed of only one curved surface or a plurality of curved surfaces of different curvatures, but is not limited thereto. The second light-reflecting cup 31 has a first focal point 31*a* and a second focal point 31*b*. In the present disclosure, as shown in FIG. 12, the first focal point 31*a* is located in the cover area of the second light-reflecting cup 31 and the second focal point 31*b* is located outside the cover area of the second light-reflecting cup 31, but is not limited thereto. The first focal point 31*a* can also be located close to an edge of an opening of the second light-reflecting cup 31, such that the second light-reflecting cup 31 has an optical axis passing through a position close to the edge.

In the present disclosure, the size of the second light-reflecting cup 31 is smaller than that of the first light-reflecting cup 21. In other words, the reflecting surface of the second light-reflecting cup 31 has a smaller surface area than that of the first light-reflecting cup 21. For example, the surface area of the reflecting surface of the first light-reflecting cup 21 is at least one and a half times larger than the surface area of the reflecting surface of the second light-reflecting cup 31. The second light-reflecting cup 31 is provided for light diffusion and the second focal point 31*b* thereof is located between the lens focal point 4*a* and a light output surface (not numbered) of the lens 4, preferably on or in proximity to a light input surface 41 of the lens 4. The light input surface 41 is a planar surface and the light output surface 41 is a curved surface.

More specifically, as shown in FIG. 12, the light input surface 41 has a first reference point 41*a*, at least one second reference point 41*b* and at least one third reference point 41*c*. The lens optical axis A passes through the first reference point 41*a*, the second reference point 41*b* is an edge point (e.g., fixed clamping point) of the light input surface 41 that has a farthest distance from the first reference point 41*a*, and the third reference point 41*c* is located between the first reference point 41*a* and the second reference point 41*b*. If the shortest distance between the first reference point 41*a* and the second reference point 41*b* is d, the second reference point 41*b* has a distance between ½d and ¾d from the third reference point 41*c*, but the present disclosure is not limited thereto.

Figure 14:
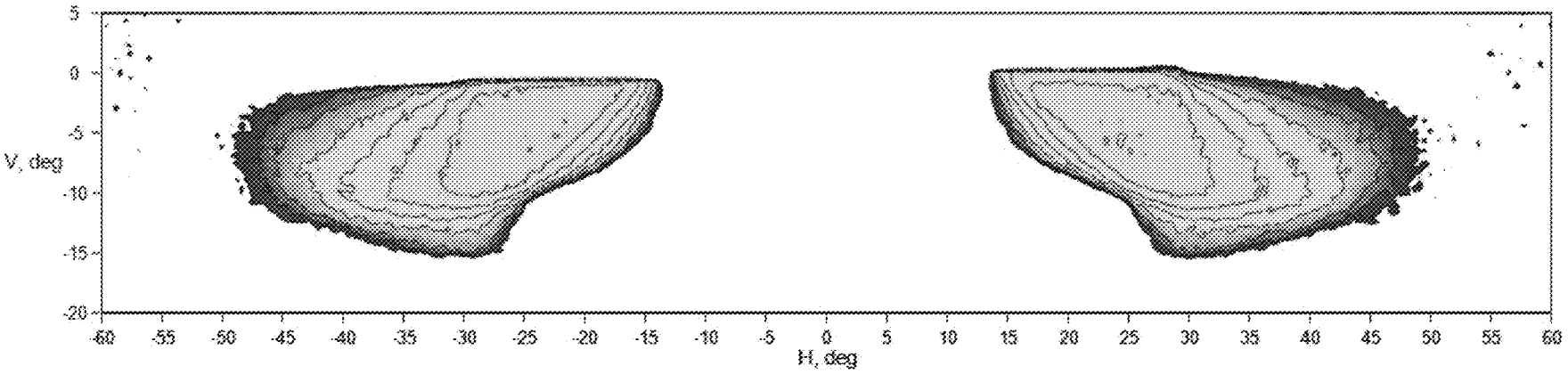
FIG. 14 is a view showing a light distribution pattern according to the auxiliary light source of the smart headlight according to the first embodiment of the present disclosure, in which a second focal point thereof is located at the best position.
Figure 15:
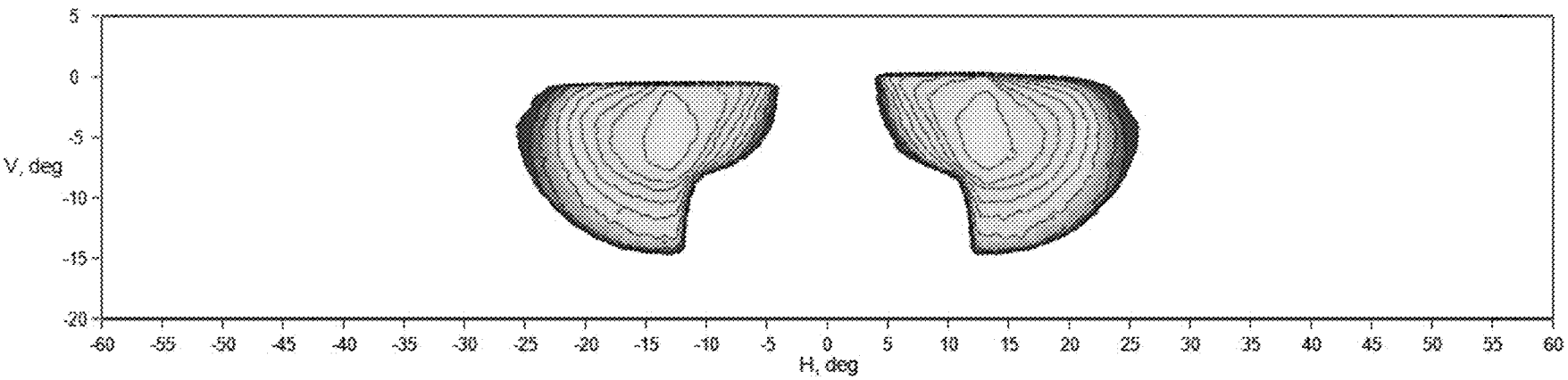
FIGS. 15 and 16 are views showing light distribution patterns according to the auxiliary light source of the smart headlight according to the first embodiment of the present disclosure, in which a second focal point thereof is located at non-best positions.
Figure 16:
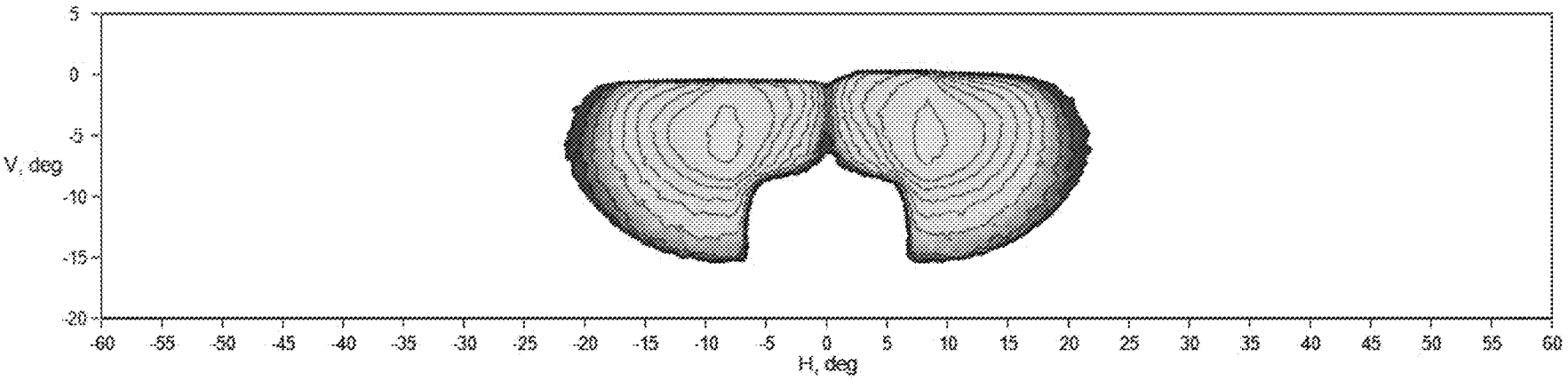
Figure 17:
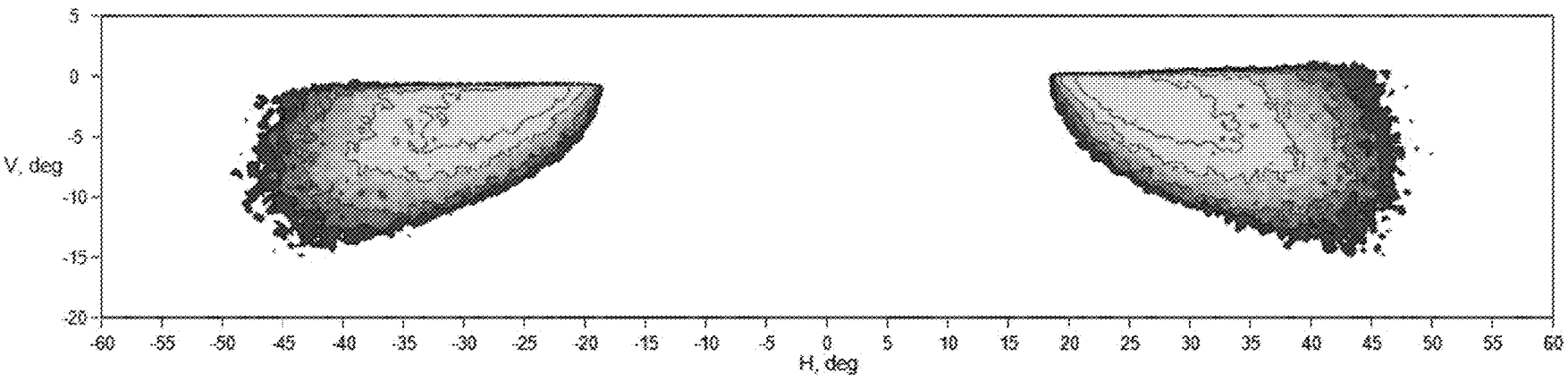
FIG. 17 is a view showing a light distribution pattern according to the auxiliary light source of the smart headlight according to the first embodiment of the present disclosure, in which a second focal point thereof is located at the preferable position.

Referring to FIGS. 12, 14 and 17, it should be noted that, when the second focal point 31*b* of the second light-reflecting cup 31 is located between the second reference point 41*b* and the third reference point 41*c*, preferably at a central position between the second reference point 41*b* and the third reference point 41*c* or in the vicinity of the central position, a high light-diffusing effect as shown in FIG. 14 can be achieved to increase the illumination range of the headlight. For example, each of the auxiliary light sources 3 can provide a light distribution pattern in a range from 10 degrees to 60 degrees or more of a left front or right front side of a vehicle. When the second focal point 31*b* of the second light-reflecting cup 31 is located outside the first reference point 41*a*, i.e., the second focal point 31*b* is not located between the second reference point 41*b* and the third reference point 41*c*, the light distribution patterns generated from the two auxiliary light sources 3 as shown in FIG. 15 converge toward each other. As shown in FIG. 16, if the second focal point 31*b* moves away from the first reference point 41*a*, the degree of the convergence of the light distribution patterns would be increased. When the second focal point 31*b* of the second light-reflecting cup 31 is located between the second reference point 41*b* and the third reference point 41*c* without the central position, the light distribution patterns generated from the auxiliary light sources 3 as shown in FIG. 17 diverge from each other but have a decreased light intensity.

More specifically, as shown in FIG. 12, a straight line passing through the first light-emitting unit 22 and being perpendicular to the lens optical axis A is defined as a first straight line L1. A straight line passing through the second reference point 41*b* and being parallel to the lens optical axis A is defined as a second straight line L2. A straight line passing through an intersection point of the first straight line L1 and the second straight line L2 is defined as a third straight line L3, and the third straight line L3 has an included angle between 2 and 17.5 degrees relative to the second straight line L2.

In the present embodiment, in order to produce a symmetrical light distribution pattern, each the numbers of the second reference point 41*b* and the third reference point 41*c* is two. The second reference points 41*b* and the third reference points 41*c* are located in symmetry relative to the first reference point 41*a*. The second focal point 31*b* of one of the second light-reflecting cups 31 is located between one of the second reference points 41*b* and one of the third reference points 41*c* that are located at one side of the first reference point 41*a*. The second focal point 31*b* of the other one of the second light-reflecting cups 31 is located between the other one of the second reference points 41*b* and the other one of the third reference points 41*c* that are located at another opposite side of the first reference point 41*a*. In other embodiments, in order to produce an asymmetrical light distribution pattern, the smart headlight D can use only one auxiliary light source 3, i.e., use only one second light-reflecting cup 31 to cooperate with a second reference point 41*b* and a third reference point 41*c*.

Figure 5:
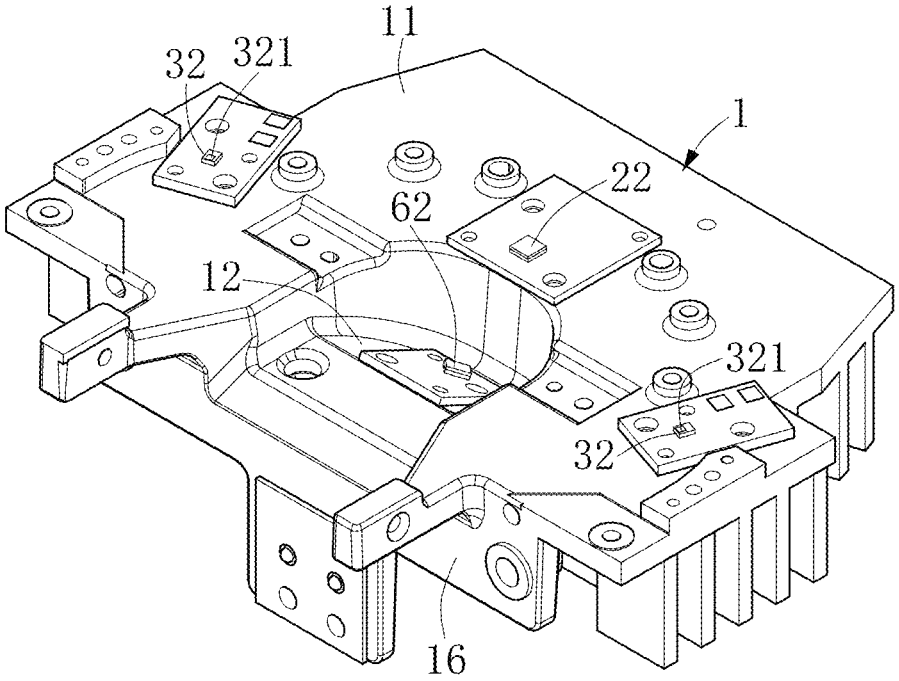
FIG. 5 is a schematic view of first, second, and third light-emitting units of the smart headlight according to the first embodiment of the present disclosure.

The second light-emitting unit 32 is disposed on a PCB (not numbered), and the PCB has a driving circuit of the second light-emitting unit 32. The PCB can be fixed on the first supporting surface 11 by at least one fixing member such as a fixing screw. The second light-emitting unit 32 can be an LED or a package structure including a plurality of LEDs. The second light-emitting unit 32 corresponds in position to the first focal point 31*a*. In the present embodiment, as shown in FIGS. 5 and 12, the second light-emitting unit 32 has a primary lighting surface 321 that is parallel to the supporting surface 11, but is not limited thereto. Preferably, the second light-emitting unit 32 is arranged in proximity to the first focal point 31*a*, i.e., the second light-emitting unit 32 is deviated from the first focal point 31*a*.

Figure 13:
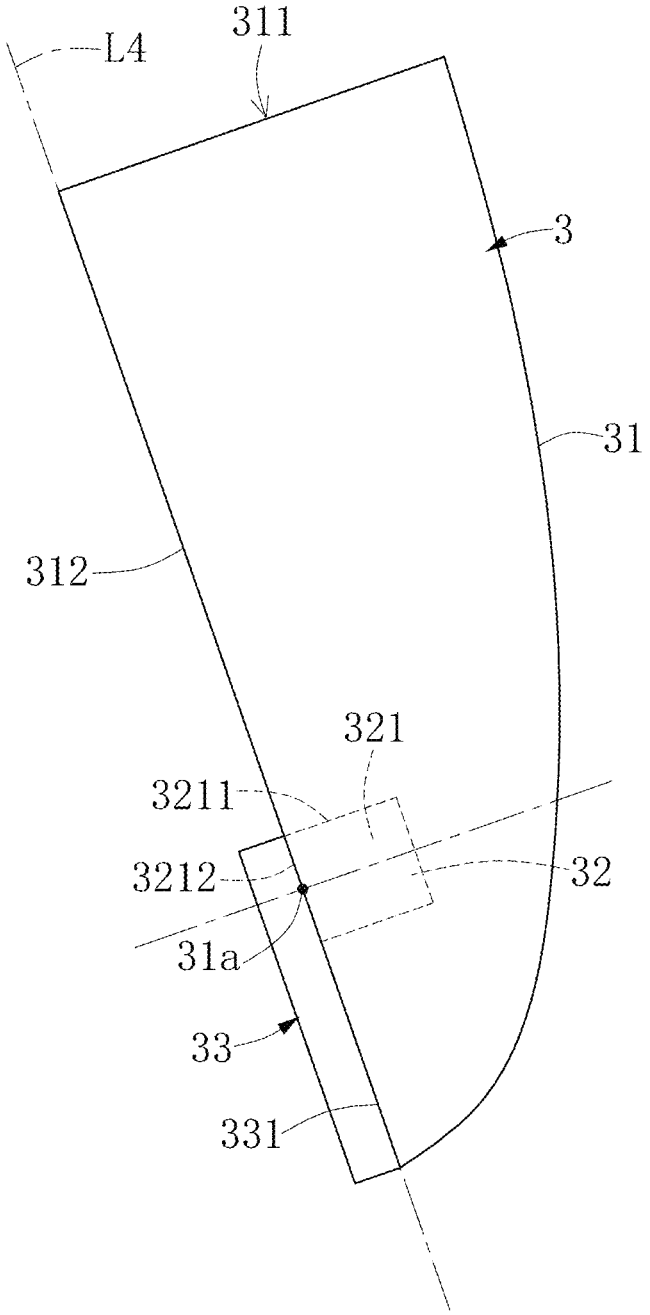
FIG. 13 is a schematic view of an auxiliary light source of the smart headlight according to the first embodiment of the present disclosure.

More specifically, as shown in FIGS. 12 and 13, the second light-reflecting cup 31 has a front opening 311 facing the lens 4 and a side opening 312 facing the main light source 2. If a straight line passing through the first focal point 31*a* and the second focal point 31*b* of the second light-reflecting cup 31 is defined as a fourth straight line L4, the side opening 312 extends along the same extension direction as the fourth straight line L4. The primary lighting surface 321 of the second light-emitting unit 32 has a first side edge 3211 exposed from the front opening 311 and a second side edge 3212 exposed from the side opening 312, and the first side edge 3211 and the second side edge 3212 are substantially perpendicular to each other. Preferably, the second side edge 3211 is substantially flush with an edge of the side opening 312, and the first focal point 31*a* of the second light-reflecting cup 31 is located on the second side edge 3211.

In the present embodiment, as shown in FIG. 13, each of the auxiliary light sources 3 can further include a reflecting mirror 33 to reduce stray light. The reflecting mirror 33 is disposed along the extension direction of the side opening 312 and has a light-reflecting planar surface 331 covering the second light-emitting unit 32. The light-reflecting planar surface 331 can be closely adjacent to the second side edge 3212, but is not limited thereto. Preferably, a front end of the reflecting mirror 33 is substantially flush with the first side edge 3211 of the primary lighting surface 321 and extends to the end of the side opening 312.

Referring to FIGS. 3 to 5 and 8 to 11, the smart headlight further includes a secondary light source 6 that is arranged on a different plane from the main light source 2 and the auxiliary light sources 3. More specifically, the headlight mount 1 further includes a second supporting surface 12 that is non-coplanar to the first supporting surface 11. The first supporting surface 11 and the second supporting surface 12 have a step difference therebetween, such that the second supporting surface 12 is located below the first supporting surface 11. The secondary light source 6 is disposed on the second supporting surface 12 and arranged in a projection area of the first light-reflecting cups 21, i.e., the secondary light source 6 is covered by the first light-reflecting cups 21 as viewed in the direction toward the first supporting surface 11.

The secondary light source 6 includes a third light-reflecting cup 61 and a third light-emitting unit 62, and lights generated from the third light-emitting unit 62 can be reflected by the third light-reflecting cup 61. The third light-reflecting cup 61 has a reflecting surface such as a partial ellipsoidal surface which can be composed of only one curved surface or a plurality of curved surfaces of different curvatures, but is not limited thereto. In the present embodiment, as shown in FIGS. 9 and 11, the third light-reflecting cup 61 has a first focal point 61*a* and a second focal point 61*b*. The first focal point 61*a* is located in the cover area of the third light-reflecting cup 61, and the second focal point 61*b* is located outside the cover area of the third light-reflecting cup 61 and coincides with the at least one second focal point 21*b* of the first light-reflecting cup 21.

Figure 3:
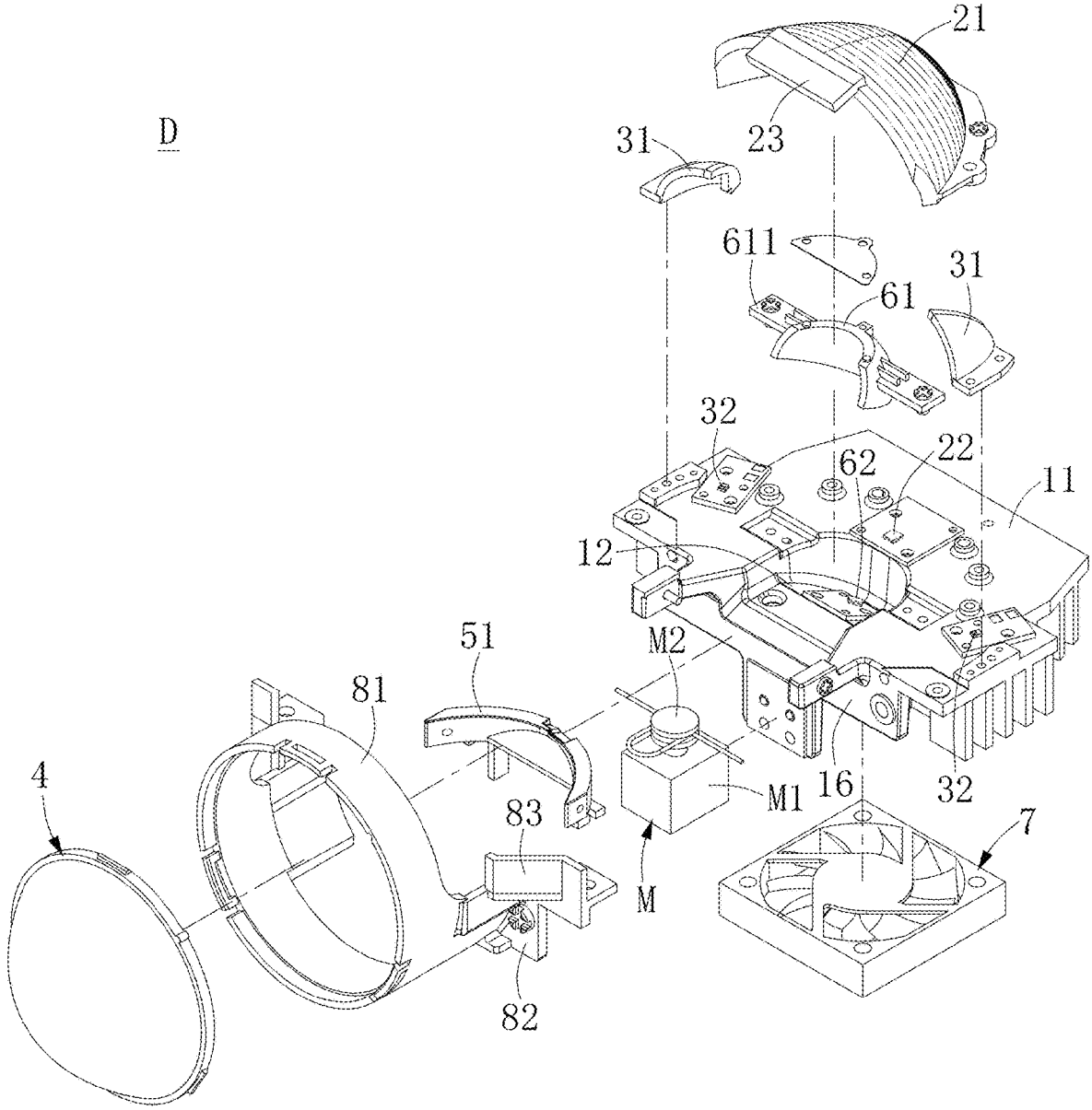
FIG. 3 is a front perspective exploded view of a smart headlight according to the first embodiment of the present disclosure.
Figure 4:
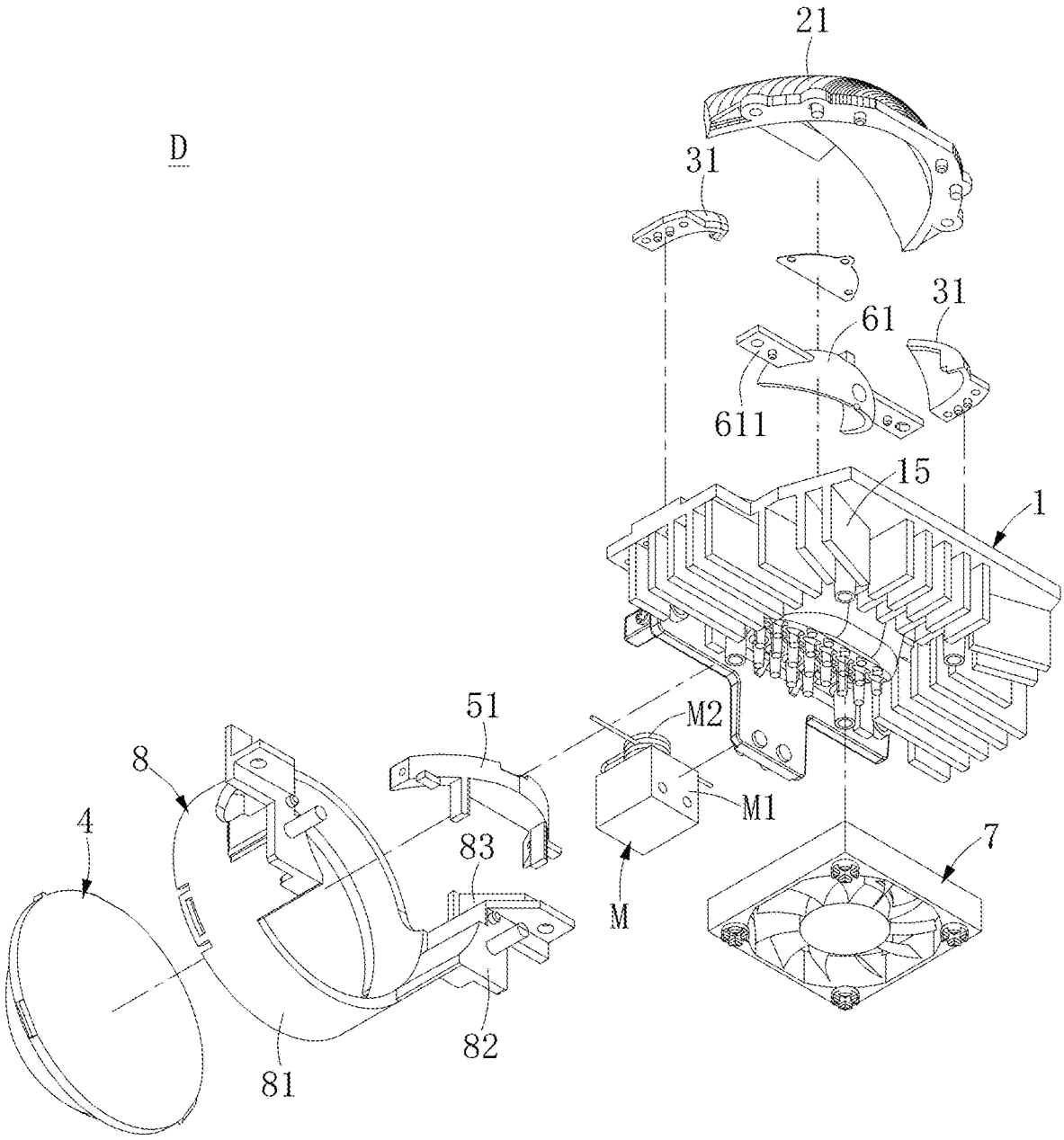
FIG. 4 is a rear perspective exploded view of a smart headlight according to the first embodiment of the present disclosure.

In the present embodiment, the headlight mount 1 has an accommodating recess (not numbered) that is recessed from the first supporting surface 11, wherein the second supporting surface 12 is the bottom surface of the accommodating recess. The second supporting surface 12 is inclined relative to the first supporting surface 11, and has an included angle between 7 degrees and 90 degrees relative to a corresponding plane, preferably between 12.5 degrees and 35 degrees. In other embodiments, the second supporting surface 12 can be parallel to the first supporting surface 11. An outer peripheral surface of the third light-reflecting cup 61 can be provided with at least one positioning plate 611 that extends outwardly and is parallel to the first supporting surface 11 as shown in FIGS. 3 and 4. The positioning plate 611 can be fixed on the first supporting surface 11 by at least one fixing member such as a fixing screw, such that the third light-reflecting cup 61 is arranged in the accommodating recess.

The size of the third light-reflecting cup 61 is smaller than that of the first light-reflecting cup 21. In other words, the reflecting surface of the third light-reflecting cup 61 has a smaller surface area than that of the first light-reflecting cup 21. For example, the surface area of the reflecting surface of the first light-reflecting cup 21 is at least one and a half times larger than the surface area of the reflecting surface of the third light-reflecting cup 61. In the present embodiment, as shown in FIGS. 9 and 11, the first focal point 61*a* of the third light-reflecting cup 61 is located at a region between the at least one first focal point 21*a* of the first light-reflecting cup 21 and the lens focal point 4*a*. The second focal point 61*b* of the third light-reflecting cup 61 is located on the lens optical axis A and coincides with the at least one second focal point 21*b* of the first light-reflecting cup 21 and the lens focal point 4*a*, but is not limited thereto. In other embodiments, the second focal point 61*b* of the third light-reflecting cup 61 can be deviated from the lens optical axis A and located in the vicinity of the at least one second focal point 21*b* of the first light-reflecting cup 21 and the lens focal point 4*a*.

The third light-emitting unit 62 is disposed on a PCB (not numbered), and the PCB has a driving circuit of the third light-emitting unit 62. The PCB can be fixed on the second supporting surface 12 by at least one fixing member such as a fixing screw. The third light-emitting unit 62 can be an LED or a package structure including a plurality of LEDs. The third light-emitting unit 62 corresponds in position to the first focal point 61*a*. In the present embodiment, the third light-emitting unit 62 can be located on or in proximity to the first focal point 61*a*. The third light-emitting unit 62 has a primary lighting surface that is parallel to the second supporting surface 12, but is not limited thereto.

Figure 10:
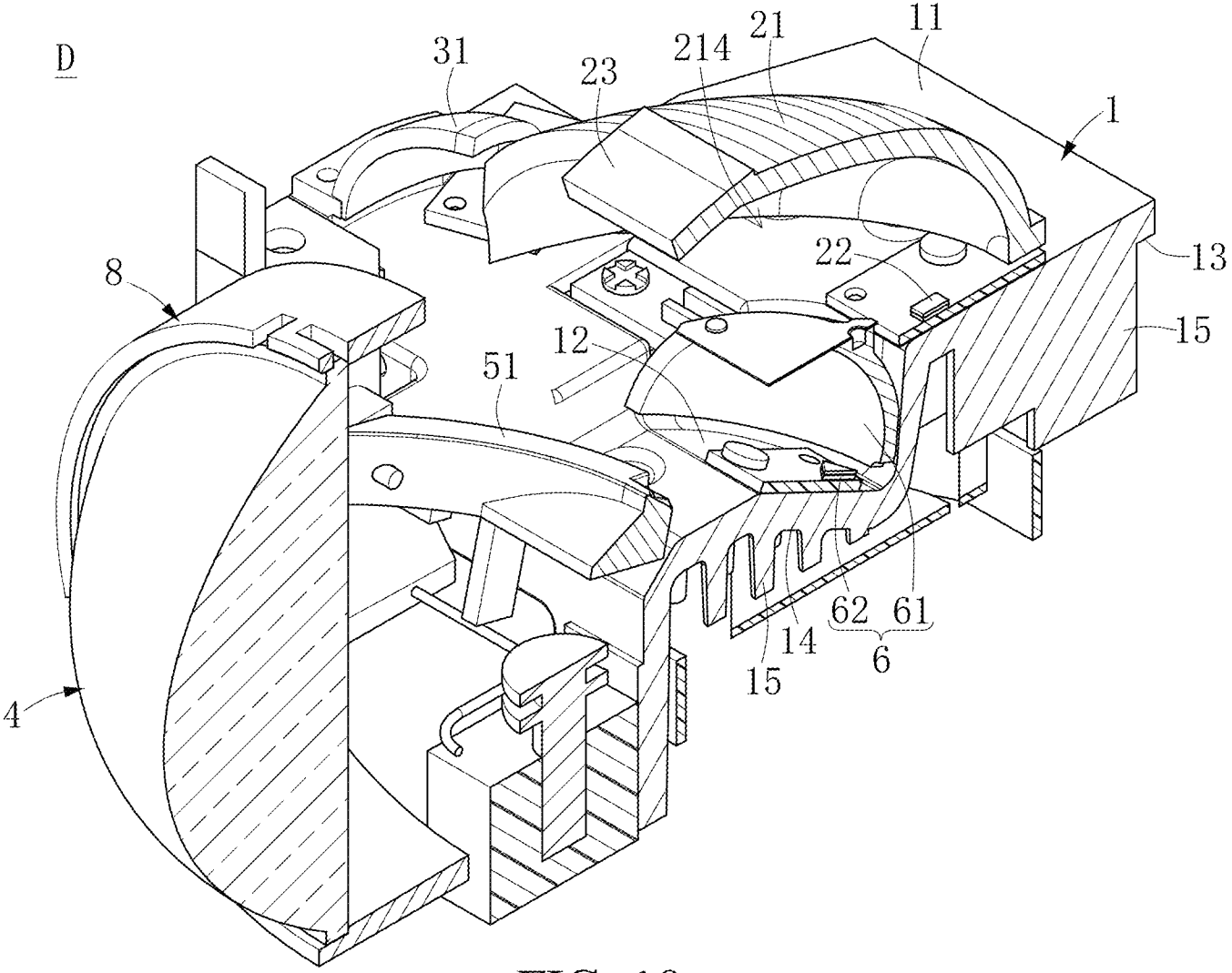
FIG. 10 is a perspective sectional view of the smart headlight in a use state according to the first embodiment of the present disclosure.

Referring to FIGS. 8 and 11, the light-shielding structure 5 is disposed between the main light source 2 or secondary light source 6 and the lens 4. The light-shielding structure 5 includes a main light-shielding plate 51 that can reciprocally move between a first position and a second position by rotating through a predetermined angle, but is not limited thereto. In the present disclosure, when the main light-shielding plate 51 is at the first position as shown in FIGS. 8 and 9, lights projected from the main light source 2 can be used to produce a low-beam lighting distribution pattern via the lens 4. When the main light-shielding plate 51 is at the second position as shown in FIGS. 10 and 11, lights projected from the main light source 2 can be used to produce a high-beam lighting distribution pattern via the lens 4. However, in practice, the present disclosure does not limit the secondary light source 6 which merely contributes to producing the low-beam lighting distribution pattern. In practice, the main light source 2 and the secondary light source 6 can simultaneously emit lights to produce the low-beam or high-beam lighting distribution pattern, wherein the lights projected from the secondary light source 6 can project outwardly through a position close to a recess structure of the main light-shielding plate 51. The technical features of the main light-shielding plate 51 will be described hereinafter in detail. Furthermore, when the main light source 2 and the secondary light source 6 simultaneously emit lights, the lights from the third light-emitting unit 62 can be guided by the third light-reflecting cup 61 for the contribution of the hot spot region (i.e., points 75R, 50V and 50R of regulation) of the low-beam light distribution pattern.

Referring to FIGS. 3, 4 and 8 to 11, more specifically, the main light-shielding plate 51 can be driven by a driving module M to reciprocally swing around a rotation axis I through a predetermined angle between 2.5 degrees and 45 degrees. The driving module M can include an electromagnetic valve M1 and a rod member M2 controlled by the electromagnetic valve M1. One end of the rod member M2 is connected to the electromagnetic valve M1 and the other end of the rod member M2 is pivotally connected to the main light-shielding plate 51. The technical details about the driving module M are well-known in the art, and will not be reiterated herein. In addition, the driving module M, which used to provide the reciprocal swinging movement of the main light-shielding plate 51, can be any suitable type of driving module. Therefore, the driving module M is not limited to the type as shown in FIGS. 3 and 4.

Figure 19:
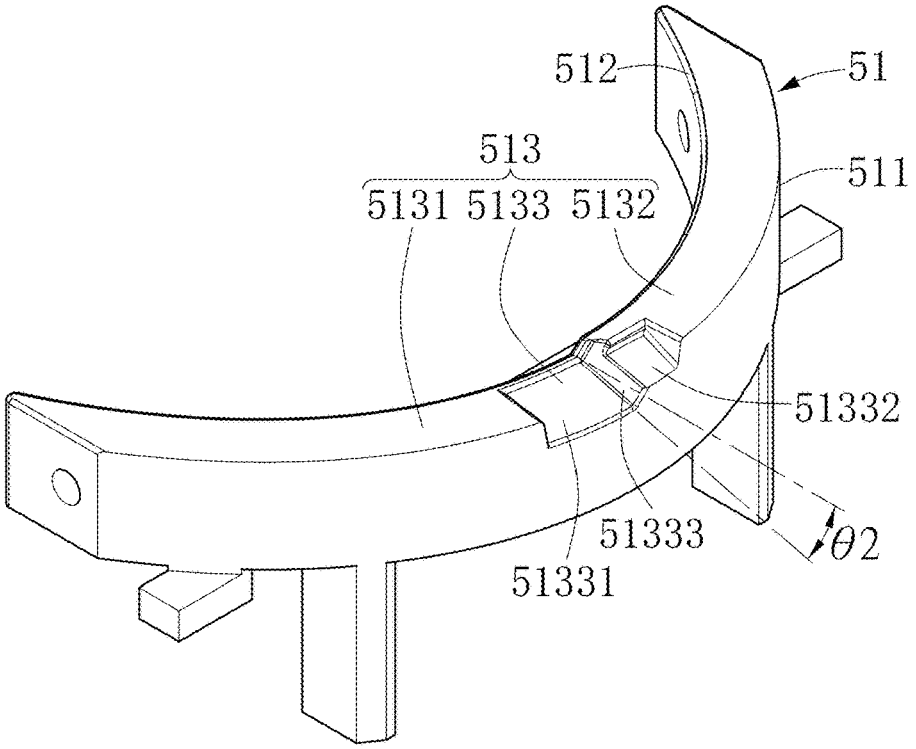
FIG. 19 is a schematic view of a light-shielding structure of the smart headlight according to the first embodiment of the present disclosure.
Figure 20:
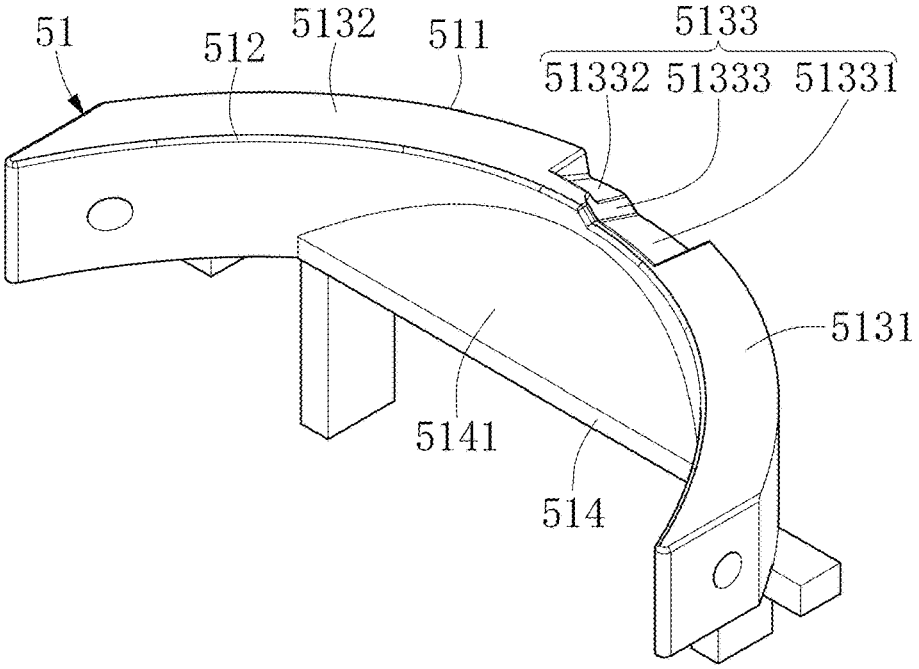
FIG. 20 is another schematic view of a light-shielding structure of the smart headlight according to the first embodiment of the present disclosure.

Referring to FIGS. 19 and 20, the main light-shielding plate 51 has an inner cut-off edge 511, an outer cut-off edge 512 opposite to the inner cut-off edge 511, and a top surface 513 connected between the inner cut-off edge 511 and the outer cut-off edge 512. The outer cut-off edge 512 is configured to define the cut-off line in compliance with regulations. Accordingly, lights projected from the main light source 2 can be selectively shielded by the main light-shielding plate 51 and refracted by the lens 4 to produce the cut-off line of the low-beam basic illumination mode. It should be noted that, a portion of the top surface 513 is inclined along a direction from the inner cut-off edge 511 toward the outer cut-off edge 512 so as to increase light-condensing effect. In the present disclosure, the inclined portion has a predetermined angle θ2 relative to a corresponding plane. The predetermined angle θ2 is greater than 0 degree and less than 60 degrees, preferably between 1 degree and 45 degrees, more preferably between 15 degrees and 35 degrees.

More specifically, the top surface 513 of the main light-shielding plate 51 has a first planar surface 5131, a second planar surface 5132 and a stepped recess structure 5133 formed between the first planar surface 5131 and the second planar surface 5132. The at least one second focal point 21*b* of the first light-reflecting cup 21, the second focal point 61*b* of the third light-reflecting cup 61 and the lens focal point 4*a* all correspond in position to the stepped recess structure 5133. The stepped recess structure 5133 includes a first oblique surface 51331, a second oblique surface 51332 and a step difference surface 51333. The step difference surface 51333 is connected between the first oblique surface 51331 and the second oblique surface 51332, such that the first oblique surface 51331 is located below the second oblique surface 51332. In the present embodiment, the first oblique surface 51331 and the second oblique surface 51332 both are inclined along a direction from the outer cut-off edge 512 toward the inner cut-off edge 511. The first oblique surface 51331 extends from the outer cut-off edge 512 to the inner cut-off edge 511, and the second oblique surface 51332 extends from a position close to the outer cut-off edge 512 to the inner cut-off edge 511. The first oblique surface 51331 has a larger surface area than the second oblique surface 51332, but is not limited thereto. In other embodiments, the first oblique surface 51331 can have a smaller surface area than the second oblique surface 51332. Furthermore, the first oblique surface 51331 and the second oblique surface 51332 can be parallel to the lens optical axis A, so as to increase the brightness of the light-diffusing area (i.e., points 25L2, 25R1, 25L3, 25R2, 15L, and 15R regulated by ECE R98 and points 25L and 25R regulated by ECE R112) of the headlight.

In addition, the main light-shielding plate 51 further includes a residual-light reflecting portion 514 that extends from the outer cut-off edge 512 and has a reflecting surface 5141 at an inclined angle to reflect a portion of the residual lights from the main light source 2 to the dark zone (i.e., Zone III as dictated by regulations), so as to increase the light intensity of the dark zone. In the present embodiment, the reflecting surface 5141 of the residual-light reflecting portion 514 has a predetermined angle relative to a corresponding plane. The predetermined angle is, for example, between 0.25 degree and 30 degrees, and can be determined according the structure of the light-guiding plate 23 of the first light-reflecting cup 21.

Referring to FIG. 11, the following will describe the cooperation of the light reflecting portion 514 of the main light-shielding plate 51 and the light-guiding plate 23 of the first light-reflecting cup 21. When an emission light E1 of the first light-emitting unit 22 projects to the reflecting surface of the first light-reflecting cup 21, a reflection light R1 is produced and passes through the second focal point 21*b* of the first light-reflecting cup 21. When an emission light E2 of the first light-emitting unit 22 projects to the light-guiding plate 23 of the first light-reflecting cup 21, it can be guided to the light reflecting portion 514 of the main light-shielding plate 51 and subsequently be reflected by the reflecting surface 5141 so as to produce a reflection light R2 projecting to the lens 4 from a position close to the lens optical axis A. The reflection light R2 can increase the light intensity of the dark zone. In addition, as shown in FIGS. 19 and 20, when another light of the first light-emitting unit 22 is guided to the first planar surface 5131 or the second planar surface 5132 of the main light-shielding plate 51, a reflection light is produced and projects to left and right side regions of the hot spot region (i.e., points 25L2, 25R1, 25L3, 25R2, 15L, and 15R regulated by ECE R98 or points 25R and 25L regulated by ECE R112), so as to increase the light-diffusing effect.

Referring to FIGS. 8 and 10, the smart headlight D can use any suitable heat-dissipating means. More specifically, the headlight mount 1 further has a first heat-dissipating surface 13 and a second heat-dissipating surface 14 opposite to the first heat-dissipating surface 13. The first heat-dissipating surface 13 and the second heat-dissipating surface 14 are respectively provided with a plurality of heat-dissipating structures 15 such as cooling fins. Accordingly, heat generated from the first, second and, third light-emitting units 22, 32, 62 can be quickly dissipated so as to ensure the reliability of the headlight and to extend the service life of the headlight. In the present disclosure, the second heat-dissipating surface 14 is non-coplanar to the first heat-dissipating surface 13 and the second heat-dissipating surface 14 has a step difference from the first heat-dissipating surface 13. Accordingly, the second heat-dissipating surface 14 is located below the first heat-dissipating surface 13. The heat-dissipating structures 15 extend along a direction away from the headlight mount 1, wherein the extension length of the heat-dissipating structures 15 disposed on the first heat-dissipating surface 13 can be longer than that of the heat-dissipating structures 15 disposed on the second heat-dissipating surface 14.

Figure 2:
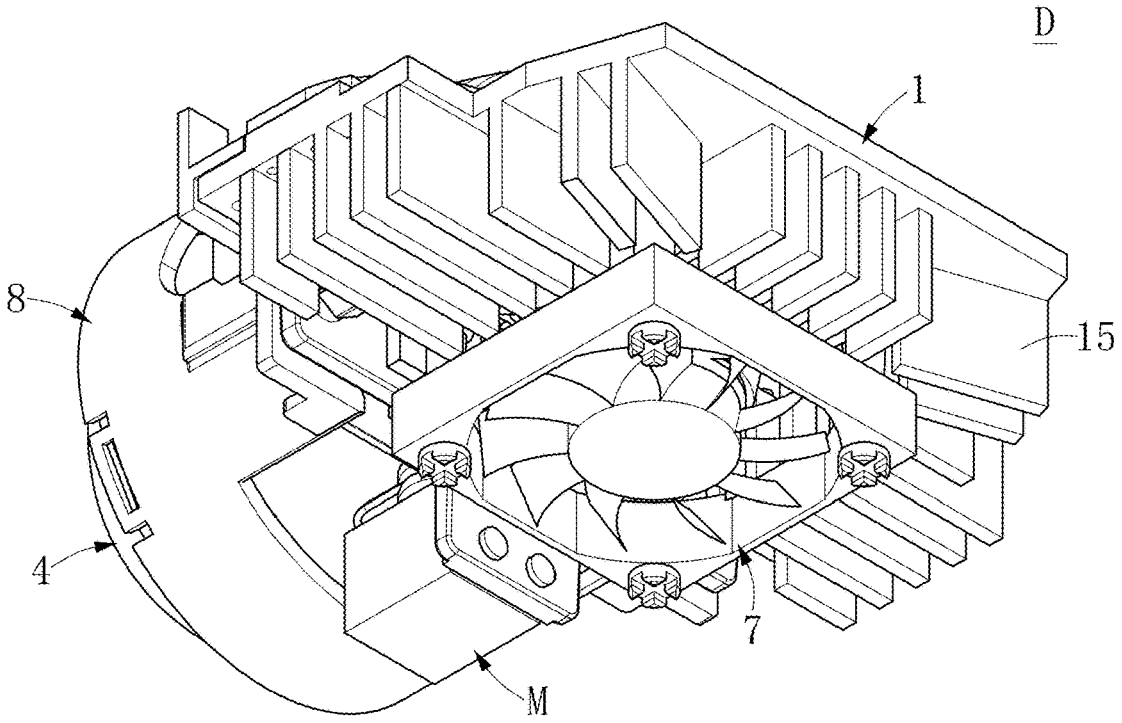
FIG. 2 is a rear perspective assembled view of the smart headlight according to the first embodiment of the present disclosure.

Referring to FIGS. 2 and 4, the smart headlight D can further include a heat-dissipating fan 7 if desired. The heat-dissipating fan can be fixed on the first heat-dissipating surface 13 and the second heat-dissipating surface 14 by at least one fixing member such as a fixing screw, so as to enhance air convection and thereby increasing heat-dissipation effect. The technical details about the structure of the heat-dissipating fan 7 are well-known in the art, and will not be reiterated herein.

Referring to FIGS. 3 to 5, the lens 4 is connected to the headlight mount 1 via a lens support 8. More specifically, the headlight mount 1 has a connecting portion 17. The connecting portion 17 is plate-shaped and extends along a direction perpendicular to the supporting surface 11. The lens support 8 has a frame body 81, two connecting arms 82 and two shielding plates 83. The lens 4 is disposed on the frame body 81. The connecting arms 82 extend from one side of the frame body 81 that faces the headlight mount 1 and are connected to the connecting portion 17. The shielding plates 83 are respectively disposed on the connecting arms 82 and respectively correspond in position to the auxiliary light sources 3, so as to shield the stray lights from the auxiliary light sources 3, thereby preventing the stray lights from leaking out to the test display.

The smart headlight D further includes a supporting frame (not shown) that is surroundingly connected to the headlight mount 1 for installing the headlight mount 1 together with the main light source 2, the auxiliary light sources 3, the lens 4, and the light shielding structure 5 onto the vehicle body.

Referring to FIG. 8, when the smart headlight D projects lights only generated from the main light source 2, the lights can be selectively shielded by the main light-shielding plate 51 and refracted by the lens 4 to produce a basic illumination mode C1 in compliance with the regulation of ECE R123. When the smart headlight D projects lights generated from the main light source 2 and the auxiliary light sources 3, the lights of the auxiliary light sources 3 can be refracted by the lens 4 to produce a curve illumination mode C3 in compliance with the regulation of ECE R119 together with the basic illumination mode C1. Therefore, a light distribution pattern with a relatively wide illumination range (i.e., a relatively wide illumination angle) or a town illumination mode (i.e., V mode) in compliance with the regulation of ECE R123 can be produced.

Second Embodiment

Figure 21:
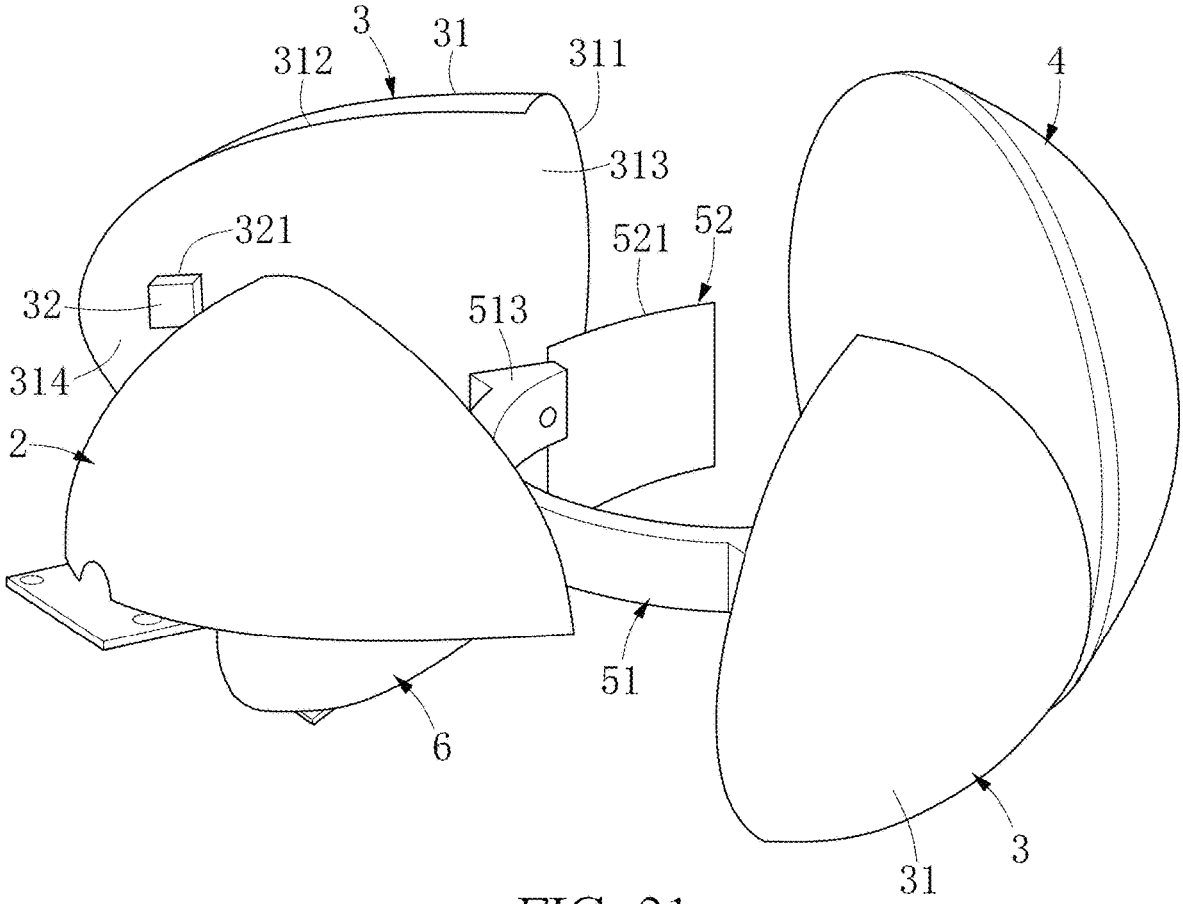
FIG. 21 is a partial perspective view of a smart headlight according to a second embodiment of the present disclosure.

Referring to FIG. 21, which is to be read in conjunction with FIGS. 1 to 5 and 8 to 12, the smart headlight D according to the second embodiment of the instant disclosure includes a main light source 2, at least one auxiliary light source 3, a lens 4 and a light-shielding structure 5. The at least one auxiliary light source 3 is disposed next to the main light source 2. The lens 4 corresponds in position to the main light source 2, and the light-shielding structure 5 is disposed between the main light source 2 and the lens 4. The smart headlight D can further include a secondary light source 6 if desired that is disposed between the main light source 2 and the light-shielding structure 5. The secondary light source 6 has a step difference from the main light source 2, such that it is located below the main light source 2. For the sake of brevity, FIG. 22 merely shows the corresponding relationships of the main and auxiliary light sources 2, 3, the lens 4, and the light-shielding structure 5, and the headlight mount 1 is omitted from FIG. 22.

The main difference between the first and second embodiments is that: the second light-reflecting cup 31 of the auxiliary light source 3 is a cup body having light-condensing function, the second light-emitting unit 32 is disposed in the second light-reflecting cup 31 and in a standing state, and the light-shielding structure 5 further includes at least one auxiliary light-shielding plate 52. More specifically, the second light-reflecting cup 31 has a front opening 311 (not shown in FIG. 21) and a side opening 312. The side opening 312 extends along the same direction as a straight line (i.e., the straight line L4 shown in FIG. 13) passing through the first focal point 31*a* and the second focal point 31*b* of the second light-reflecting cup 31. Furthermore, the second light-reflecting cup 31 has an upper reflecting surface 313 and a lower reflecting surface 314 that are respectively located above and below the first supporting surface 11 and can be symmetrical or asymmetrical with respective to each other. Preferably, the upper reflecting surface 313 and the lower reflecting surface 314 are symmetrical with respective to the first supporting surface 11. The second light-emitting unit 32 has a primary lighting surface 321 that is perpendicular to the first supporting surface 11 and the rear thereof faces the side opening 312. Accordingly, the light projection direction of the second light-emitting unit 32 is backward with respect to the side opening 312.

In the presence of the main light source 2 and the two auxiliary light sources 3, the light-shielding structure 5 further includes two auxiliary light-shielding plates 52 in proximity of the main light-shielding plate 51. The main light-shielding plate 51 corresponds in position to the main light source 2 and the two auxiliary light-shielding plates 52 respectively correspond in position to the two auxiliary light sources 3. The main light-shielding plate 51 is configured to selectively shield the lights projected from the main light source 2 so as to produce a low-beam basic illumination mode C2. The two auxiliary light-shielding plates 52 are configured to respectively shield the lights projected from the two auxiliary light sources 3 so as to produce a curve illumination mode C3. Therefore, the basic illumination mode C1 together with curve illumination mode C3 can be produced when the main light source 2 and the two auxiliary light sources 3 simultaneously project lights. It should be noted that, the light-shielding structure 5 includes only one auxiliary light source 52 in the presence of only auxiliary light sources 3, and therefore an asymmertical light distribution pattern is produced.

The technical details about the main light-shielding plate 51 are well-known in the art, and will not be reiterated herein. It should be noted that each of the auxiliary light-shielding plates 52 has an inclined top surface 521, wherein one end of the top surface 521 is adjacent to the top surface 513 of the main light-shielding plate 51 and can be located above or substantially flush with the top surface 513 of the main light-shielding plate 51. The top surface 521 of the auxiliary light-shielding plate 52 is downwardly inclined toward the lens 4. Therefore, any light distribution pattern, which is produced with the basic light distribution pattern, can have a clear horizontal cut-off line so as to modify the bending light distribution pattern.

Third Embodiment

Figure 22:
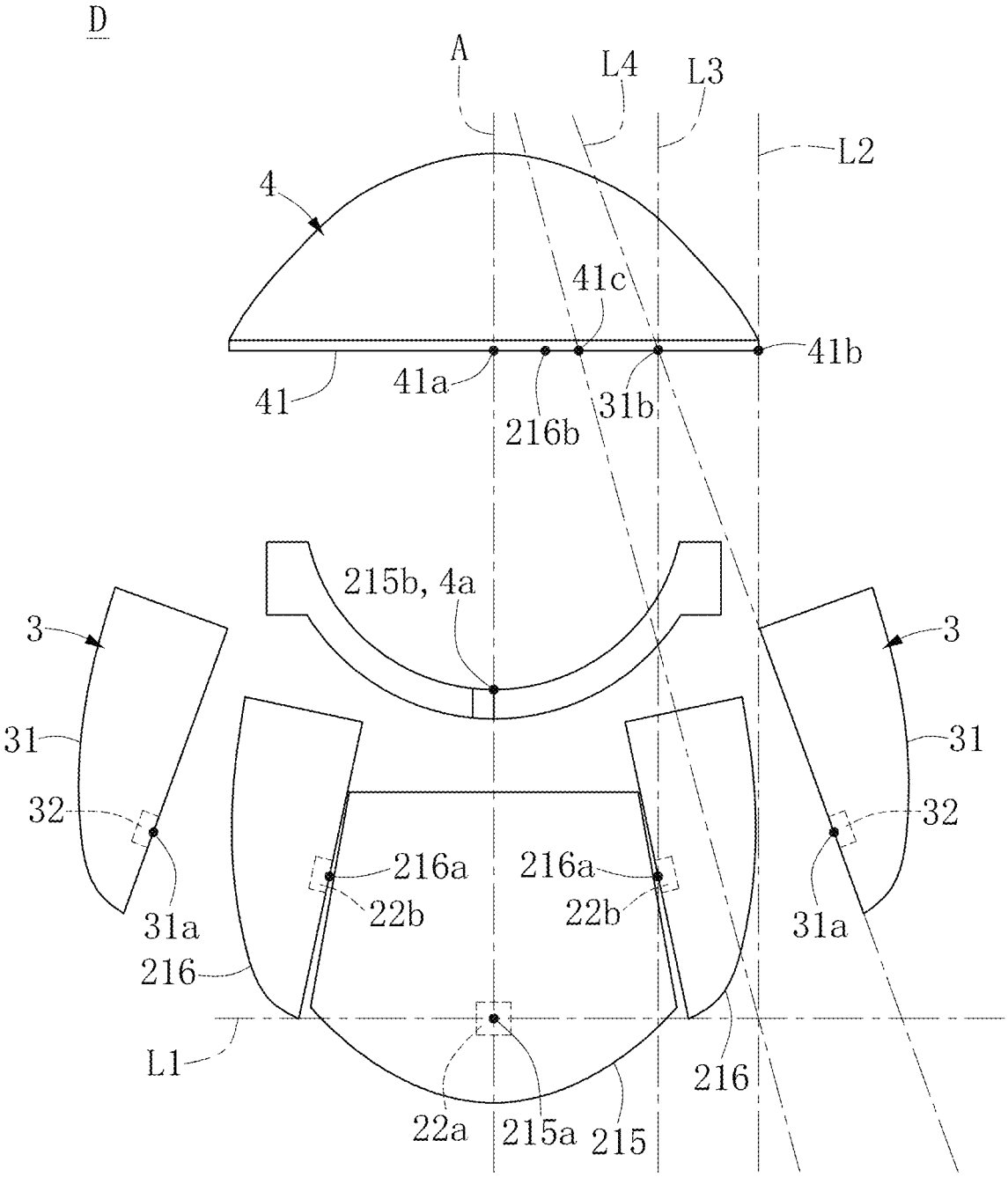
FIG. 22 is a schematic view showing an optical configuration of a smart headlight according to a third embodiment of the present disclosure.
Figure 23:
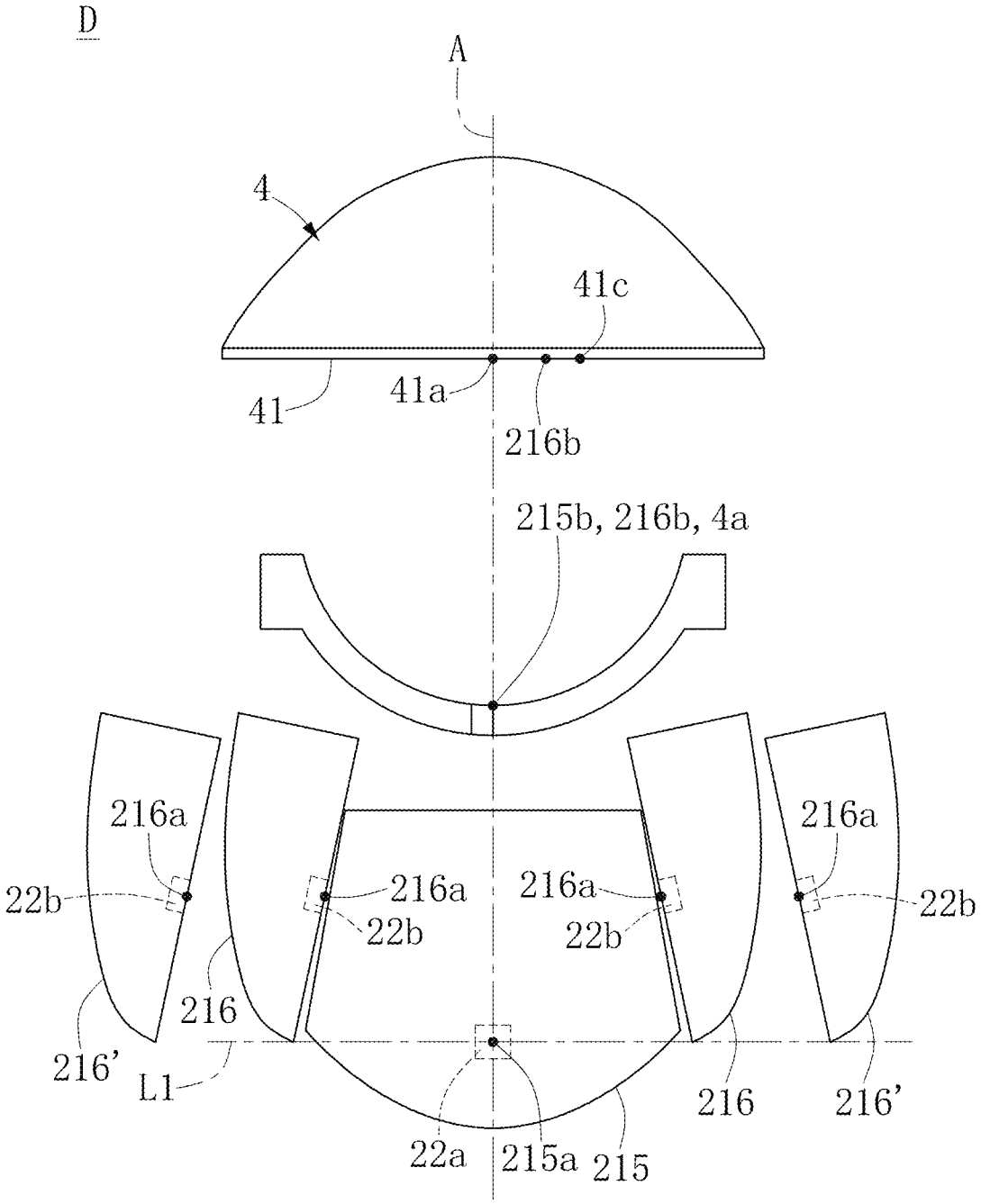
FIG. 23 is a schematic view showing another optical configuration of the smart headlight according to the third embodiment of the present disclosure.
Figure 24:
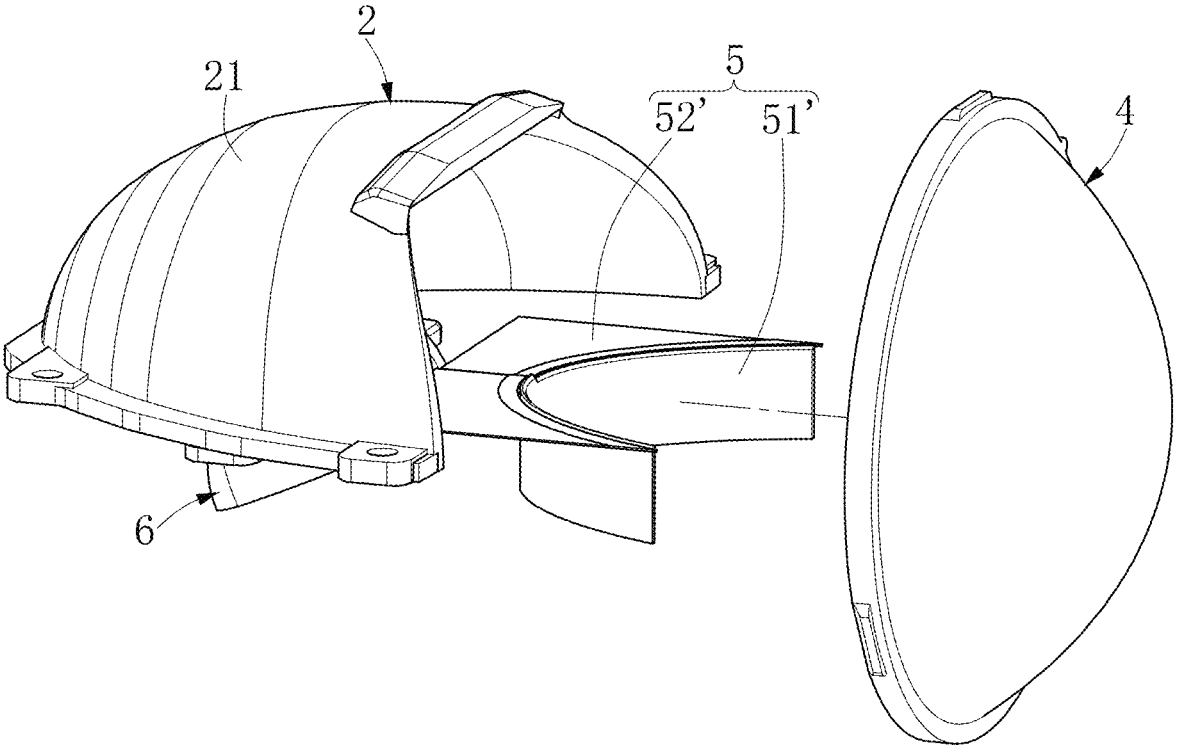
FIGS. 24 to 26 are partial perspective views of a smart headlight according to a fourth embodiment of the present disclosure.

Referring to FIGS. 22 and 23, which are to be read in conjunction with FIGS. 1 to 5 and 8 to 12, the smart headlight D according to the third embodiment of the instant disclosure includes a main light source 2, at least one auxiliary light source 3, a lens 4 and a light-shielding structure 5. The at least one auxiliary light source 3 is disposed next to the main light source 2. The lens 4 corresponds in position to the main light source 2, and the light-shielding structure 5 is disposed between the main light source 2 and the lens 4. The smart headlight D can further include a secondary light source 6 if desired that is disposed between the main light source 2 and the light-shielding structure 5. The secondary light source 6 has a step difference from the main light source 2, such that it is located below the main light source 2. For the sake of brevity, FIG. 22 merely shows the corresponding relationships of the main and auxiliary light sources 2, 3, the lens 4, and the light-shielding structure 5, and the headlight mount 1 is omitted from FIG. 22.

The main difference between the first and third embodiments is that: the first light-reflecting cup 21 of the main light source 2 includes a primary reflecting portion 215 and at least one secondary reflecting portion 216 disposed next to the primary reflecting portion 215. In the present embodiment, the main example of the main light source 2 includes a primary reflecting portion 215 and two secondary reflecting portions 216 closely adjacent to left and right sides of the primary reflecting portion 215. The primary reflecting portion 215 is configured to implement light-condensing effect and the secondary reflecting portions 216 are configured to implement light-diffusing effect. More specifically, the primary reflecting portion 215 has a first focal point 215*a* located in the cover area thereof and a second focal point 215*b* located outside the cover area, wherein the second focal point 215*b* can be located on the lens optical axis A and coincide with the lens focal point 4*a*, but is not limited thereto. In other embodiments, the second focal point 215*b* of the primary reflecting portion 215 can be deviated from the lens optical axis A and in the vicinity of the lens focal point 4*a*.

Each of the secondary reflecting portions 216 has a reflecting surface which can be a composite ellipsoidal curved surface and has a first focal point 216*a* and at least one second focal point 216*b*. The first focal point 216*a* is located in the cover area of the secondary reflecting portion 216 and the at least one second focal point 216*b* is located outside the cover area of the secondary reflecting portion 216. For example, in the condition that the reflecting surface of the secondary reflecting portion 216 is a composite ellipsoidal curved surface, the second focal point 216*b* can be located on the lens focal point 4*a*, the light input surface 41, or any position between the lens focal point 4*a* and the light input surface 41. If each of the secondary reflecting portions 216 has a plurality of second focal points 216*b*, the second focal points 216*b* can be respectively located on the aforesaid positions.

Figure 18:
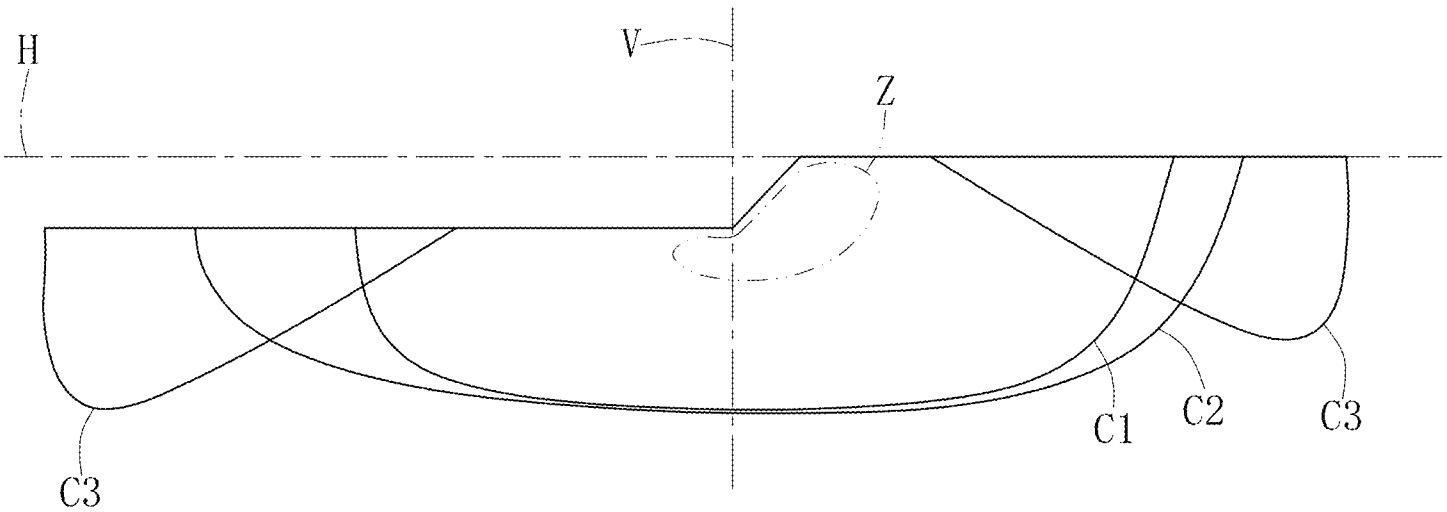
FIG. 18 is a view showing different light distribution patterns of the smart headlight according to the first embodiment of the present disclosure.

Referring to FIGS. 18 and 23, the first light-reflecting cup 21 of the main light source 2 can further include at least one secondary reflecting portion 216' distant from the primary reflecting portion 215 that is arranged next to the secondary reflecting portion 216 adjacent to the primary reflecting portion 215. The secondary reflecting portion 216 adjacent to the lens focal point 4*a* can implement a light-diffusing effect near the hot zone Z of the light distribution pattern, and the secondary reflecting portion 216' distant from the lens focal point 4*a* can implement a light-diffusing effect far away from the hot zone Z of the light distribution pattern. The first light-emitting unit 22 includes a plurality of lighting elements 22*a*, 22*b*, wherein the lighting element 22*a* corresponds in position to the first focal point 215*a* of the primary reflecting portion 215 and the lighting element 22*b* corresponds in position to the first focal point 216*a* of the secondary reflecting portion 216. In the present embodiment, the lighting element 22*a* can be located on or in proximity to the first focal point 215*a* of the primary reflecting portion 215. The lighting element 22*b* can be located on or in proximity to the first focal point 216*a* of the secondary reflecting portion 216, preferably in proximity to the first focal point 216*a* of the secondary reflecting portion 216 (i.e., being deviated from the secondary reflecting portion 216). It should be noted that, when the second focal point 216*b* of the secondary reflecting portion 216 is located between the first reference point 41*a* and the third reference point 41*c* of the light input surface 41, preferably at a central position between the second reference point 41*a* and the third reference point 41*c*, the light distribution pattern according to the main light source 2 can become wider.

Referring to FIGS. 18 and 22, an example of the main light source 2 includes a primary reflecting portion 215 and two secondary reflecting portions 216 closely adjacent to left and right sides of the primary reflecting portion 215. When the main light source 2 uses only the primary reflecting portion 215 to project lights, the lights can be selectively shielded by the main light-shielding plate 51 and refracted by the lens 4 to produce a basic illumination mode C1 in compliance with the regulation of ECE R123. When the main light source 2 uses the primary reflecting portion 215 and the secondary reflecting portions 216 to simultaneously project lights, the lights projected from the secondary reflecting portions 216 can be refracted by the lens 4 to increase the illumination range (i.e., illumination angle) of the basic illumination mode C1 according to the primary reflecting portion 215, so as to produce a wide-angle illumination mode C2.

Referring to FIGS. 18 and 23, another example of the main light source 2 includes a primary reflecting portion 215, two secondary reflecting portions 216 adjacent to left and right sides of the primary reflecting portion 215, and two secondary reflecting portions 216' distant from the primary reflecting portion 215. When the main light source 2 only uses the primary reflecting portion 215 to project lights, the lights can be used to produce a light distribution pattern of the hot zone and its peripheral portion in the basic illumination mode C1 in compliance with the regulation of ECE R123. When the main light source 2 uses the primary reflecting portion 215 and the secondary reflecting portions 216 adjacent the lens optical axis 4*a* to simultaneously project lights, the basic illumination mode C1 in compliance with the regulation of ECE R123 can be produced. When the main light source 2 uses the primary reflecting portion 21, the secondary reflecting portions 216 adjacent to the lens optical axis 4*a*, and the secondary reflecting portions 216' distant from the lens optical axis 4*a* to simultaneously project lights, the wide-angle illumination mode C2 can be produced.

Although the smart headlight D as shown FIG. 22 used a main light source 2 and two auxiliary light sources 3 arranged in symmetry to produce symmetrical light distribution patterns, depending on particular requirements, the smart headlight D can use a main light source 2 and a plurality of auxiliary light sources 3 arranged in asymmetry to produce asymmetrical light distribution patterns. For example, two auxiliary light sources 3 are disposed at the left side of main light source 2 and an auxiliary light source 3 is disposed at the right side of main light source 2. For example, only two auxiliary light sources 3 are disposed at the left or right side of main light source.

Fourth Embodiment

Referring to FIGS. 24 to 30, which are to be read in conjunction with FIGS. 1 to 5 and 8 to 12, the smart headlight D of this embodiment has the substantially same structure as that of the first embodiment. The main difference of the smart headlight D of this embodiment is that the light-shielding structure 5 only includes a first light-shielding plate 51' and a second light-shielding plate 52' behind the first light-shielding plate 51', and the first light-shielding plate 51' is moveable 1 and the light-shielding plate 52' is stationary. For the sake of brevity, FIGS. 24 to 30 merely show the corresponding relationships of a portion of the main light source, a portion of the auxiliary light source 3, the lens 4, and the light-shielding structure 5. More specifically, the first light-shielding plate 51' and the second light-shielding plate 52' are disposed between the main light source 2 and the lens 4. The second light-shielding plate 52' is adjacent to the first light-shielding plate 51' and is closer to the main light source 2 than the first light-shielding plate 51'. In the present embodiment, the first light-shielding plate 51' is a vertical-type light-shielding plate, the second light-shielding plate 52' is a flat-type light-shielding plate, and the shortest distance between the first light-shielding plate 51' and the second light-shielding plate 52' is between 0.1 mm and 5 mm, but the present disclosure is not limited thereto. The first light-shielding plate 51' is configured to define a first illumination mode according the main light source 2 and the second light-shielding plate 52' is configured to define a second illumination mode according the main light source 2. The first illumination mode and the second illumination mode both are low-beam light distribution patterns in compliance with the regulation of ECE R123.

Figure 25:
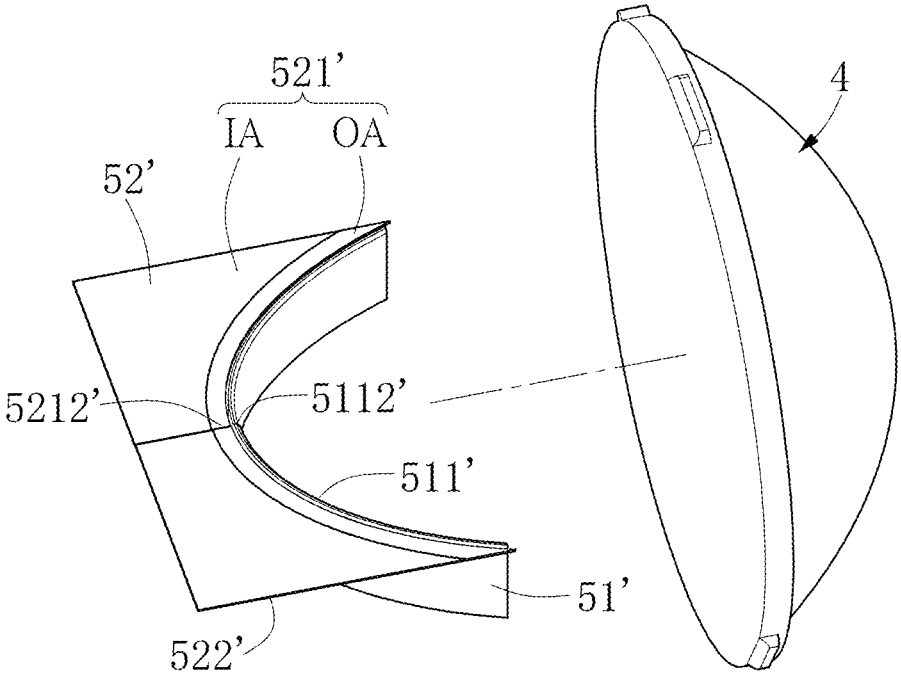
Figure 26:
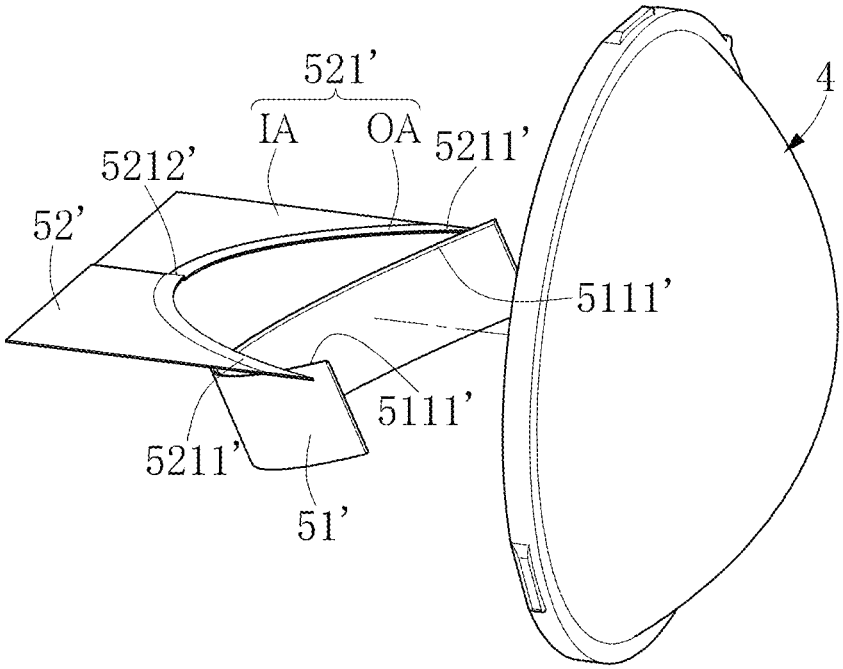
Figure 27:
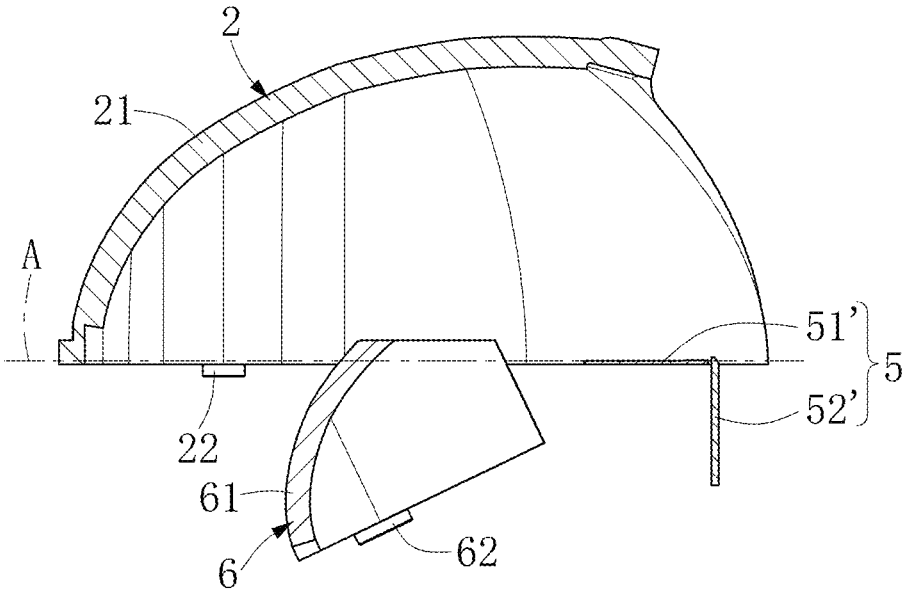
FIGS. 27 and 28 are schematic views showing an optical configuration of the smart headlight according to the fourth embodiment of the present disclosure.
Figure 28:
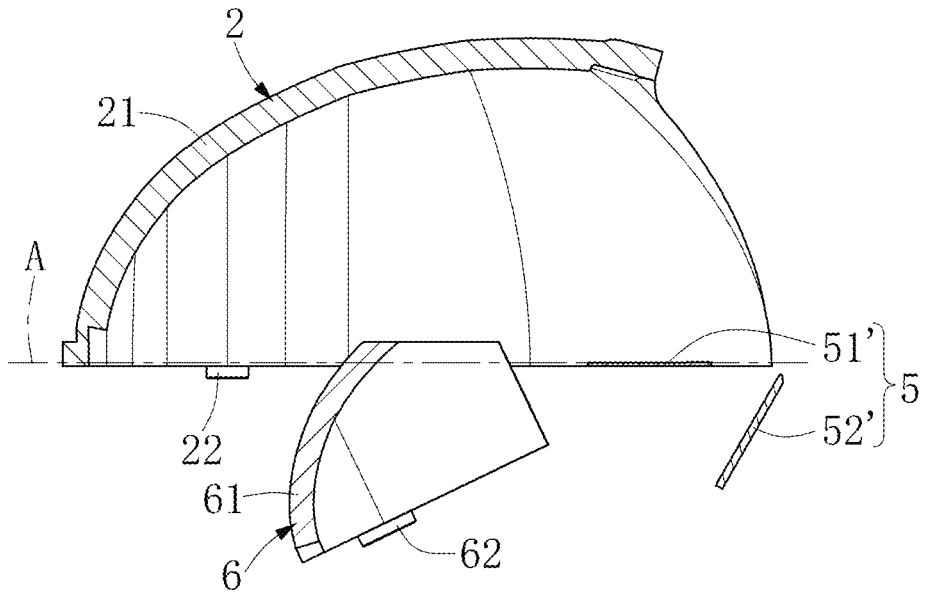

Referring to FIGS. 25 and 26, each of top portions of the first light-shielding plate 51' and the second light-shielding plate 52' has a profile for defining the cut-off line in compliance with regulations. More specifically, the top portion of the first light-shielding plate 51' has a first top surface 511' having two first planar surfaces 5111' and a first step difference surface 5112'. The first step difference surface 5112' is connected between the first planar surfaces 5111' such that the first planar surfaces 5111' have a height difference. The top portion of the second light-shielding plate 52' has a second top surface 521' having an inner side region IA and an outer side region OA. The outer side region OA is closer to the first light-shielding plate 51' than the inner side region IA' and has two second planar surfaces 5211' and a second step difference surface 5212'. The second step difference surface 5212' is connected between the second planar surfaces 5211' such that the second planar surfaces 5211' have a height difference. In other embodiments, the inner side region IA and the outer side region OA can be regarded as a whole area and there is no difference therebetween. More specifically, the first planar surface 5111' of the first top surface 511' at a higher position is located above the second planar surface 5211' of the second top surface 521' at a higher position. The first planar surface 5111' of the first top surface 511' at a lower position is located above or substantially flush with the second planar surface 5211' of the second top surface 521' at a lower position. It should be noted that each of the first planar surfaces 5111' of the first top surface 511' and each of the second planar surfaces 5211' of the second top surface 521' can be replaced by an inclined surface that is inclined from the front to the rear to provide a different optical effect.

Figure 33:
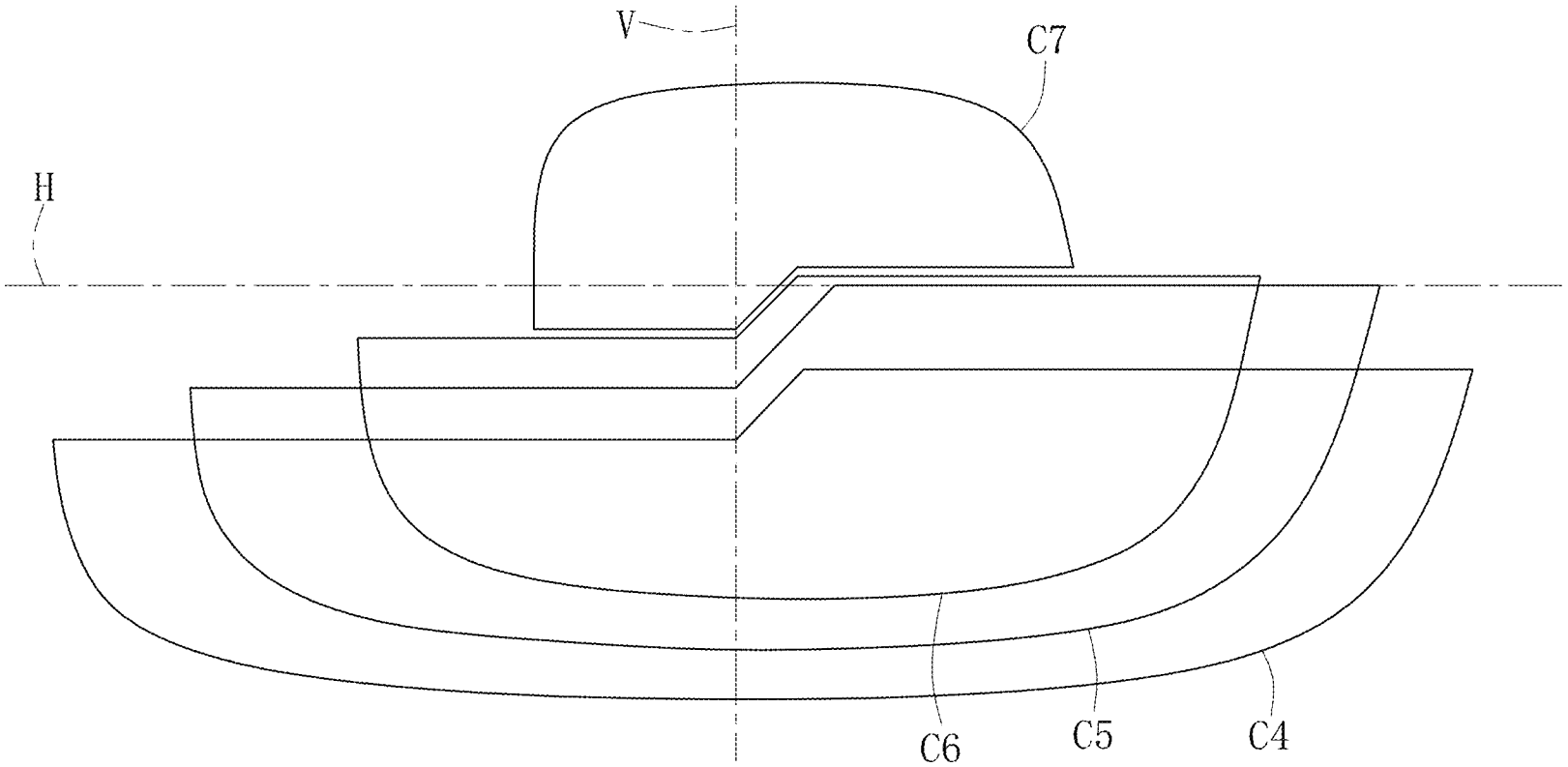
FIG. 33 is a view showing light distribution patterns of the smart headlight according to the fourth and fifth embodiments of the present disclosure.

Referring to FIGS. 25, 26, and 33, the first top surface 511' is located above the second top surface 521', and the first light-shielding plate 51' is configured to reciprocally move between an upright position and a reclined position by rotating through a predetermined angle, but is not limited thereto. When the first light-shielding plate 51' is at the upright position as shown in FIG. 25, the second light-shielding plate 52' is covered by the first light-shielding plate 51'. Accordingly, lights projected from the main light source 2 are selectively shielded by a top portion of the first light-shielding plate 51' and refracted by the lens 4 to produce a first illumination mode C4 or second illumination mode C5. When the first light-shielding plate 51' is at the reclined position as shown in FIG. 26, the first light-shielding plate 51' has an included angle relative to a corresponding plane. The included angle can be from 1 degree to 50 degrees, such that a top portion of the second light-shielding plate 52' is exposed from the first light-shielding plate 51'. Accordingly, lights projected from the main light source 2 are selectively shielded by the top portion of the second light-shielding plate 52' and refracted by the lens 4 to produce a second illumination mode C5 or third illumination mode C6. In the condition that the secondary light source 6 projects lights, the lights can be selectively shielded by the top portion of the second light-shielding plate 52' and refracted by the lens 4 to produce a high-beam illumination C7. The technical details about reciprocal movement of the first light-shielding plate 51' are well-known in the art, and will not be reiterated herein. For example, the first light-shielding plate 51' can be driven by an electromagnetic valve to reciprocally move between an upright position and a reclined position.

It should be noted that, the first top surface 511' and the outer side region OA of the second top surface 521' both have a light extinction property. In implementation, the first top surface 511' and the outer side region OA of the second top surface 521' can be provided with a light extinct coating that can be made from a black paint or any other low reflectance material. In addition, the first top surface 511' and the outer side region OA of the second top surface 521' can be surface treated (i.e., surface sandblasted) to provide an optical diffuse reflection function, but is not limited thereto. The inner side region IA of the second top surface 521' can have a light reflection or light extinction property. In implementation, the inner side region IA of the second top surface 521' can be provided with a light reflection or light extinction coating, wherein the light reflection coating can be made from aluminum, silver, or any other high reflectance material and the light extinction coating that is made from a black paint or any other low reflectance material. The difference is that when the inner side region IA of the second top surface 521' has the light reflection property, the illumination range of the main light source 2 can be increased. Therefore, the cut-off line can be provided with an ideal profile, i.e., the edge portions at two opposite sides of the hot zone extend straightly.

Furthermore, the second light-shielding plate 52' has a second bottom surface 522' opposite to the second top surface 521'. The second bottom surface 522' can have a light reflection property if desired. In implementation, the second bottom surface 522' can be provided with a light reflection coating made from aluminum, silver, or any other high reflectance material, but is not limited thereto. Therefore, the high-beam light distributed pattern according the secondary light source 6 can be modified, and the high-beam illumination mode C7 provided by the secondary light source 6 and the first, second, or third illumination mode C4-C6 provided by the main light source 2 can be clearly separated from each other as shown in FIG. 33.

More specifically, the first illumination mode C4 has a near illumination distance and a wide illumination range, the second illumination mode C5 has a far illumination distance and a narrow illumination range, and the third illumination mode C6 has a relatively far illumination distance and a relatively narrow illumination range. For example, the first illumination mode C4 is a town illumination mode (i.e., V mode), the second illumination mode C5 is a basic illumination mode (i.e., C mode), and the third illumination mode C6 is a highway illumination mode (i.e., E mode). Furthermore, when the main light source 2 and the auxiliary light sources 3 simultaneously project lights, together, the basic illumination mode in compliance with the regulation of ECE R123 can be produced together with a curve illumination mode (i.e., T mode).

It is worth mentioning that, in the present embodiment, the light intensities of the first light-emitting unit 21 of the main light source 2 and the second light-emitting unit 31 of the auxiliary light source 3 can be adjusted to modify a specific illumination mode. For example, an illumination mode can be modified to have an increased illumination distance or illumination angle.

Figure 29:
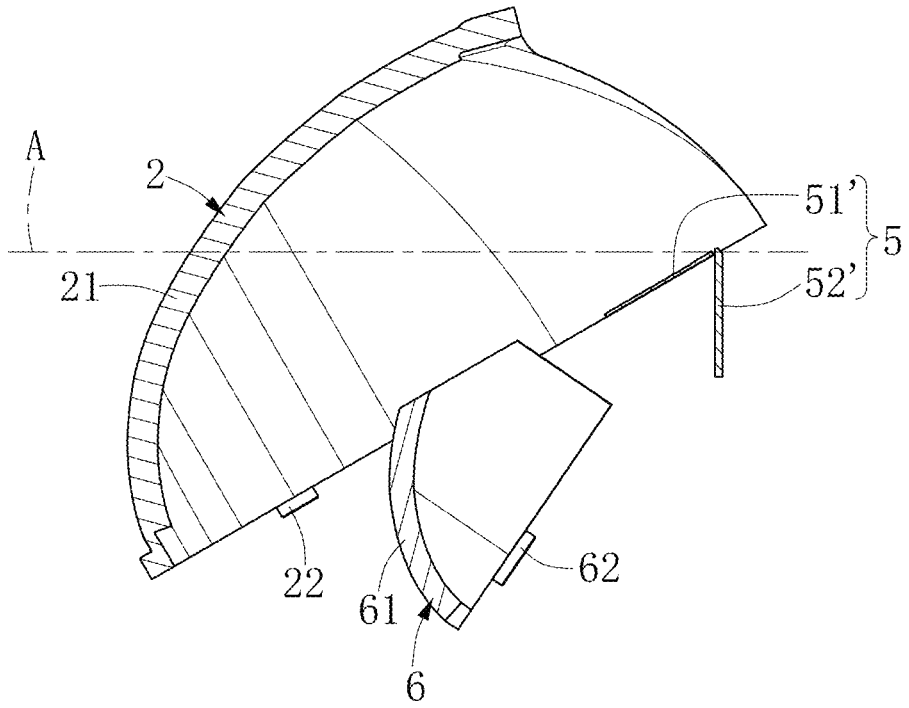
FIGS. 29 and 30 are schematic views showing another optical configuration of the smart headlight according to the fourth embodiment of the present disclosure.
Figure 30:
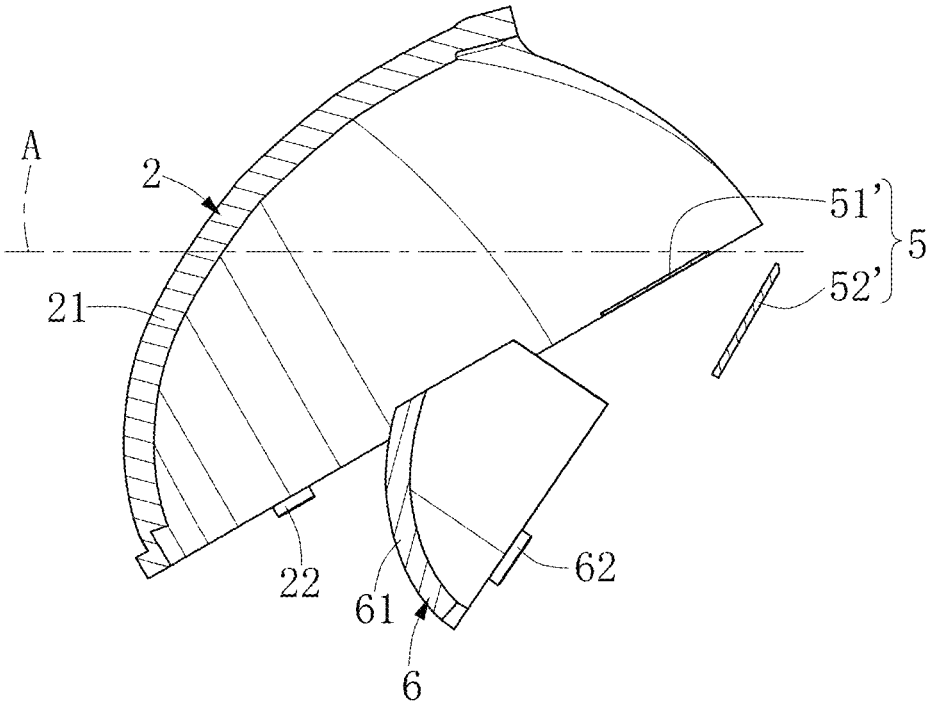

It is worth mentioning that, although the first light-emitting unit 21 of the main light source 2 and the first light-shielding plate 51' are disposed at a horizontal state, i.e., the first light-emitting unit 21 and the first light-shielding plate 51' are parallel to the lens optical axis A, depending on different implementations, the first light-emitting unit 21 and the first light-shielding plate 51' can be disposed at an inclined angle as shown in FIGS. 29 and 30 and along the same inclination direction. The inclined angle of the first light-shielding plate 51' can be less than or equal to that of the first light-emitting unit 21, but is not limited thereto.

Fifth Embodiment

Figure 31:
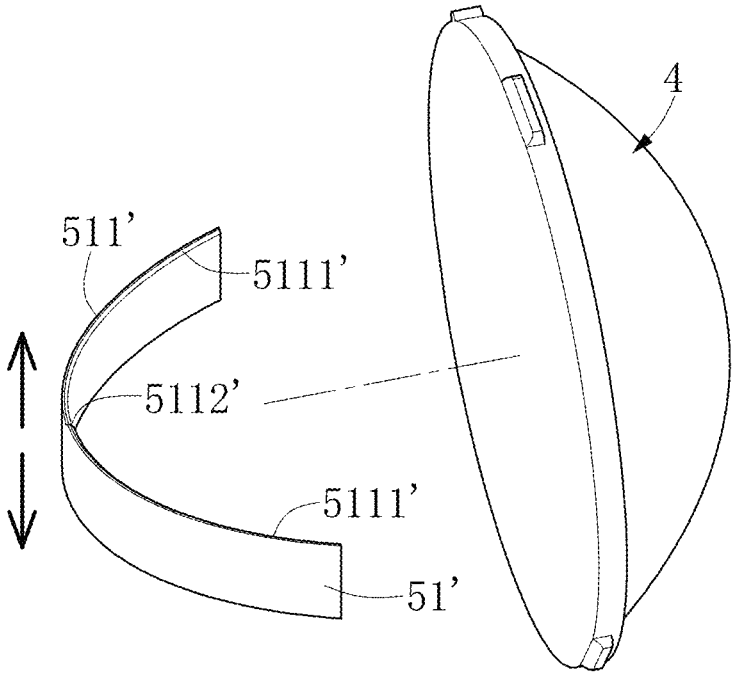
FIGS. 31 and 32 are partial perspective views of a smart headlight according to a fifth embodiment of the present disclosure.
Figure 32:
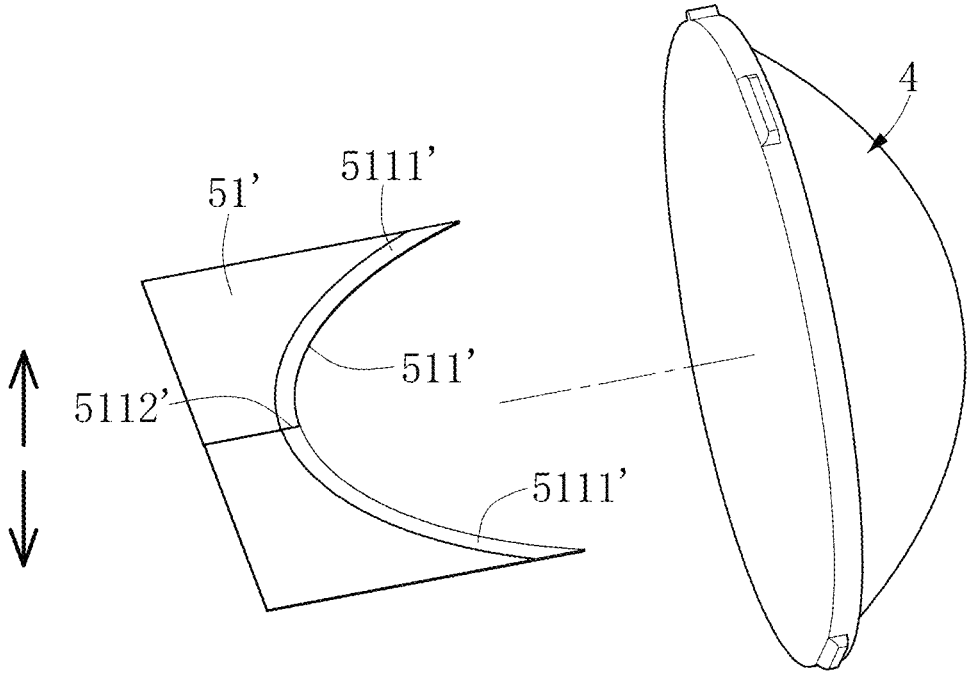

Referring to FIGS. 31 and 32, which are to be read in conjunction with FIGS. 1 to 5 and 8 to 12, the smart headlight D of this embodiment has the substantially same structure as that of the fourth embodiment. The main difference of the smart headlight D of this embodiment is that the light-shielding structure 5 only includes a first light-shielding plate 51' that can move a direction (i.e., y-direction) perpendicular to the first supporting surface and reciprocally move between a first position, a second position, and a third position. The first position is higher than the second position and the second position is higher than the third position.

More specifically, the first light-shielding plate 51' can be a vertical-type light-shielding plate as shown in FIG. 31 or a flat-type light-shielding plate as shown in FIG. 32. The first light-shielding plate 51' has a top surface 511' having a profile for defining the cut-off line in compliance with regulations. The first top surface 511' has two first planar surfaces 5111' and a first step difference surface 5112'. The first step difference surface 5112' is connected between the first planar surfaces 5111' such that the first planar surfaces 5111' have a height difference. It should be noted that each of the first planar surfaces 5111' of the top surface 511' can be replaced by an inclined surface that is inclined from the front to the rear to provide a different optical effect.

Referring to FIG. 33, the main light source 2 can be used to produce a first illumination mode C4 when the first light-shielding plate 51' is at the first position, the main light source 2 can be used to produce a second illumination mode C5 when the first light-shielding plate 51' moves downwardly to the second position, and the main light source 2 can be used to produce a third illumination mode C6 which can be defined when the first light-shielding plate 51' moves downwardly to the third position. The first illumination mode C4, the second illumination mode C5 and the third illumination mode C6 all are low-beam light distribution patterns in compliance with the regulation of ECE R123. More specifically, the first illumination mode C4 has a near illumination distance and a wide illumination range, the second illumination mode C5 has a far illumination distance and a narrow illumination range, and the third illumination mode C6 has a relatively far illumination distance and a relatively narrow illumination range. For example, the first illumination mode C4 is a town illumination mode (i.e., V mode), the second illumination mode C5 is a basic illumination mode (i.e., C mode), and the third illumination mode C6 is a highway illumination mode (i.e., E mode). Furthermore, when the main light source 2 and the auxiliary light sources 3 simultaneously project lights, together the basic illumination mode in compliance with the regulation of ECE R123 can be produced together with a curve illumination mode (i.e., T mode).

It is worth mentioning that, in the present embodiment, the light intensities of the first light-emitting unit 21 of the main light source 2 and the second light-emitting unit 31 of the auxiliary light source 3 can be adjusted to modify a specific illumination mode. For example, an illumination mode can be modified to have an increased illumination distance or illumination angle. In addition, the first light-shielding plate 51' of the present disclosure is not limited to provide three lift stages. In other embodiments, the first light-shielding plate 51' can reciprocally move between two positions, for example between the first and second positions or between the second and third positions, to define different illumination modes according the main light source 2.

One of the advantages of the present disclosure is that the smart headlight, in which the at least one auxiliary light source is disposed next to the main light source in symmetrical arrangement, the light shielding structure is disposed between the main light source and the lens, and the second light-reflecting cup of the auxiliary light source has a second focal point that is arranged at a specific position of the light input surface of the lens, can provide light distribution patterns adapted to different road environments and have a bending illumination function.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated.

Alternative embodiments will become apparent to those skilled in the art to which the present disclosure pertains without departing from its spirit and scope.

What is claimed is:

1. A smart headlight, comprising:

a headlight mount;

a main light source disposed on the headlight mount, wherein the main light source includes a first light-reflecting cup and a first light-emitting unit, the first light-reflecting cup has at least one first focal point located in a cover area of the first light-reflecting cup, and the first light-emitting unit corresponds in position to the at least one first focal point of the first light-reflecting cup;

a lens connected to the headlight mount and corresponding in position to the main light source; and a light shielding structure including a first light-shielding plate and a second light-shielding plate, wherein the first light-shielding plate is configured to reciprocally move between an upright position and a reclined position;

wherein when the first light-shielding plate is at the upright position, the second light-shielding plate is covered by the first light-shielding plate, such that lights projected from the main light source is selectively shielded by a top portion of the first light-shielding plate and refracted by the lens to produce a first illumination mode;

wherein when the first light-shielding plate is at the reclined position, a top portion of the second light-shielding plate is exposed from the first light-shielding plate, such that lights projected from the main light source is selectively shielded by the top portion of the second light-shielding plate and refracted by the lens to produce a second illumination mode;

wherein the second illumination mode has a farther illuminating distance than the first illumination mode.

2. The smart headlight according to claim 1, wherein the shortest distance between the first light-shielding plate and the second light-shielding plate is between 0.1 mm and 5 mm.

3. The smart headlight according to claim 2, wherein the top portion of the first light-shielding plate has a first top surface, the first top surface has two first planar surfaces and a first step difference surface connected between the first planar surfaces, and one of the first planar surfaces is located above the other one of the first planar surfaces, wherein the top portion of the second light-shielding plate has a second top surface, the second top surface has an inner side region and an outer side region, and the outer side region is closer to the first light-shielding plate than the inner side region, and wherein the outer side region has two second planar surfaces and a second step difference surface connected between the second planar surfaces, and one of the second planar surfaces is located above the other one of the second planar surfaces.

4. The smart headlight according to claim 3, wherein the first planar surface at a higher position is located above the second planar surface at a higher position, and the first planar surface at a lower position is located below the second planar surface at a lower position.

5. The smart headlight according to claim 3, wherein the first planar surface at a higher position is located above the second planar surface at a higher position, and the first planar surface at a lower position is substantially flush with the second planar surface at a lower position.

6. The smart headlight according to claim 3, wherein the first top surface and the outer side region of the second top surface have a light extinction property and the inner side region of the second top surface has a light reflection property.

7. The smart headlight according to claim 3, wherein the first top surface and the inner side region and the outer side region of the second top surface all have a light reflection property.

8. The smart headlight according to claim 1, further comprising at least one auxiliary light source disposed on the headlight mount and arranged next to the main light source, wherein the auxiliary light source includes a second light-reflecting cup and a second light-emitting unit, the second light-reflecting cup has a first focal point and a second focal point corresponding in position to the first focal point, and the second light-emitting unit corresponds in position to the first focal point of the second light-reflecting cup, wherein the lens has a lens optical axis and a light input surface, the light input surface has a first reference point, a second reference point and a third reference point, the lens optical axis passes through the first reference point, the second reference point is an edge point of the light input surface that has a farthest distance from the first reference point, and the third reference point is arranged between the first reference point and the second reference point, and wherein d represents the shortest distance between the first reference point and the second reference point, the third reference point has a distance between ½d and ¾d from the second reference point, and the second focal point of the second light-reflecting cup is arranged between the second reference point and the third reference point.

9. The smart headlight according to claim 8, wherein the second focal point of the second light-reflecting cup is arranged at a central position between the second reference point and the third reference point or in the vicinity of the central position.

10. The smart headlight according to claim 8, wherein a straight line passing through the first light-emitting unit and being perpendicular to the lens optical axis is defined as a first straight line, a straight line passing through the second reference point and being parallel to the lens optical axis is defined as a second straight line, a straight line passing through an intersection point of the first straight line and the second straight line is defined as a third straight line, and the third straight line has an included angle between 2 and 17.5 degrees relative to the second straight line.

11. The smart headlight according to claim 8, wherein a fourth straight line passing through the first focal point and the second focal point of the second light-reflecting cup is defined, the second light-reflecting cup has a front opening facing the lens and a side opening facing the main light source, and the side opening extends along the same extension direction as the fourth straight line, and wherein the headlight mount has a supporting surface, the second light-emitting unit is disposed on the supporting surface and has a primary lighting surface that is parallel to the supporting surface, the primary lighting surface has a first side edge exposed from the front opening and a second side edge exposed from the side opening, and the second side edge is flush with an edge of the side opening.

12. The smart headlight according to claim 11, wherein the auxiliary light source further includes a reflecting mirror that is disposed along the extension direction of the side opening and has a light-reflecting planar surface covering the second light-emitting unit, and the light-reflecting planar surface is closely adjacent to the second side edge.

13. The smart headlight according to claim 12, wherein the reflecting mirror has a front end that is substantially flush with the second side edge of the primary lighting surface.

14. The smart headlight according to claim 8, wherein a fourth straight line passing through the first focal point and the second focal point of the second light-reflecting cup is defined, the second light-reflecting cup has a front opening facing the lens and a side opening facing the main light source, and the side opening extends along the same extension direction as the fourth straight line, wherein the headlight mount has a supporting surface, and the second light-reflecting cup has an upper reflecting surface and a lower reflecting surface that are respectively located above and below the supporting surface, wherein the second light-emitting unit is disposed on the supporting surface and has a primary lighting surface that is perpendicular to the supporting surface and faces away from the side opening, wherein the light-shielding structure includes a main light-shielding plate and at least one auxiliary light-shielding plate in proximity of the main light-shielding plate, the main light-shielding plate corresponds in position to the main light source and has a top surface, and the auxiliary light-shielding plate corresponds in position to the auxiliary light source and has a top surface, and wherein one end of the top surface of the auxiliary light-shielding plate is located above or substantially flush with the top surface of the main light-shielding plate, and the top surface of the auxiliary light-shielding plate is downwardly reclined toward the lens.

15. The smart headlight according to claim 1, wherein the first light-reflecting cup includes a primary reflecting portion and at least one secondary reflecting portion disposed next to the primary reflecting portion, the number of the first focal point of the first light-reflecting cup is two, one of the first focal points is located in a cover area of the primary reflecting portion, and the other one of the first focal points is located in a cover area of the secondary reflecting portion, wherein the first light-emitting unit includes two lighting elements, one of the lighting elements corresponds in position to the first focal point of the primary reflecting portion, and the other one of the lighting elements corresponds in position to the first focal point of the secondary reflecting portion, and wherein the secondary reflecting portion further has a second focal point that is outside the cover area of the secondary reflecting portion and located between the first reference point and a third reference point.

16. The smart headlight according to claim 15, wherein the second focal point of the secondary reflecting portion is located at a central position between the first reference point and the third reference point or in the vicinity of the central position.

17. A smart headlight, comprising:

a headlight mount;

a main light source disposed on the headlight mount, wherein the main light source includes a first light-reflecting cup and a first light-emitting unit, the first light-reflecting cup has at least one first focal point located in a cover area of the first light-reflecting cup, and the first light-emitting unit corresponds in position to the at least one first focal point of the first light-reflecting cup;

a lens connected to the headlight mount and corresponding in position to the main light source; and a light shielding structure including a first light-shielding plate that is configured to reciprocally move between a first position and a second position lower than the first position;

wherein when the first light-shielding plate is at the first position, lights projected from the main light source is selectively shielded by a top portion of the first light-shielding plate and refracted by the lens to produce a first illumination mode;

wherein when the first light-shielding plate is at the second position, lights projected from the main light source is selectively shielded by the top portion of the first light-shielding plate and refracted by the lens to produce a second illumination mode;

wherein the second illumination mode has a farther illuminating distance than the first illumination mode.

18. The smart headlight according to claim 17, wherein the first light-shielding plate has a first top surface, the first top surface has two first planar surfaces and a first step difference surface connected between the first planar surfaces, and one of the first planar surfaces is located above the other one of the first planar surfaces.

* * * * *